US006158849A

United States Patent [19]

Veciana et al.

[11] Patent Number: 6,158,849

[45] Date of Patent: Dec. 12, 2000

[54] PRINTER CARRIAGE ALIGNMENT FOR PERIODIC INK REPLENISHMENT FROM OFF-CARRIAGE INK SUPPLY

[75] Inventors: Joaquim Veciana; Ignacio de Olazabal, both of Sant Cugat del Valles, Spain

[73] Assignee: Hewlett Packard Company, Palo Alto, Calif.

[21] Appl. No.: 09/032,343

[22] Filed: Feb. 27, 1998

Related U.S. Application Data

[63] Continuation-in-part of application No. 08/805,861, Mar. 3, 1997, Pat. No. 6,106,109.

[51] Int. Cl.[7] ..... B41J 2/175

[52] U.S. Cl. ..... 347/85

[58] Field of Search ..... 347/84, 85, 86, 347/87, 13, 29

[56] References Cited

U.S. PATENT DOCUMENTS

| | | | |
|---|---|---|---|
| 3,930,258 | 12/1975 | Dick et al. | 347/7 |
| 4,223,323 | 9/1980 | Bader et al. | 347/85 |
| 4,412,232 | 10/1983 | Weber et al. | 347/86 |
| 4,475,116 | 10/1984 | Sicking et al. | 347/86 |
| 4,500,895 | 2/1985 | Buck et al. | 347/87 |
| 4,714,937 | 12/1987 | Kaplinsky | 347/86 |
| 4,831,389 | 5/1989 | Chan | 347/86 |
| 4,833,491 | 5/1989 | Rezanka | 347/93 |
| 4,929,963 | 5/1990 | Balazar | 347/89 |
| 4,959,667 | 9/1990 | Kaplinsky | 347/87 |
| 4,967,207 | 10/1990 | Ruder | 347/85 |
| 4,968,998 | 11/1990 | Allen | 347/7 |
| 4,970,528 | 11/1990 | Beaufort et al. | 346/25 |
| 5,121,132 | 6/1992 | Pan et al. | 347/87 |
| 5,126,767 | 6/1992 | Asai | 347/86 |
| 5,136,305 | 8/1992 | Ims | 347/7 |
| 5,280,300 | 1/1994 | Fong et al. | 347/87 |

FOREIGN PATENT DOCUMENTS

| | | |
|---|---|---|
| 0 237 787 A3 | 2/1987 | European Pat. Off. . |
| 237787 A2 | 9/1987 | European Pat. Off. . |
| 0 519 664 A2 | 6/1992 | European Pat. Off. . |
| 0536980 A2 | 4/1993 | European Pat. Off. . |
| 93 00 133 U | 1/1993 | Germany . |
| 61-12347 | 1/1986 | Japan . |

OTHER PUBLICATIONS

Patent Abstracts of Japan, Publication No. 6024835, Sep. 12, 1985, Cannon, Inc., "Fluid Jet Recording Device" (1 page).

Patent Abstracts of Japan, published by the European Patent Office, Publication Number: 60248355, Publication Date: Sep. 12, 1985.

*Primary Examiner*—N. Le
*Assistant Examiner*—Anh T. N. Vo

[57] ABSTRACT

A technique for aligning a carriage holding a pen in a printing machine including a carriage axis assembly having a motor drive system for moving the carriage along a carriage axis, a carriage position sensor, and a refill station disposed along the axis. A carriage alignment position at which the pen septum is aligned with the refill valve is determined, by (i) actuating the motor drive system to move the carriage in a first direction along the carriage axis to a first end of carriage travel along the carriage axis, (ii) sensing the position of the carriage at the first end of carriage travel, and storing the sensed first end position, (iii) actuating the motor drive system to move the carriage in a second direction along the carriage axis until the carriage runs into contact with a refill stopper surface of the refill station, (iv) determining a refill stopper carriage position at which the carriage runs into the refill stopper surface, and (v) determining the alignment position from the refill stopper carriage position. The carriage is moved along the carriage axis during printing operations and dispenses droplets of liquid ink from the printhead onto a print medium. A refill operation is conducted by moving the carriage to the alignment position, engaging the pen septum and the refill valve, passing ink through the refill valve and the pen septum, and disengaging the refill valve from the pen septum.

(List continued on next page.)

22 Claims, 19 Drawing Sheets

U.S. PATENT DOCUMENTS

| | | | |
|---|---|---|---|
| 5,329,294 | 7/1994 | Ontawar et al. | 347/87 |
| 5,359,353 | 10/1994 | Hunt et al. | 347/86 |
| 5,367,320 | 11/1994 | Erickson | 347/7 |
| 5,369,429 | 11/1994 | Erickson | 347/7 |
| 5,563,591 | 10/1996 | Jacobs et al. | 347/13 |
| 5,631,681 | 5/1997 | Klaus et al. | 347/85 |
| 5,650,811 | 7/1997 | Secombe et al. | 347/85 |
| 5,686,947 | 11/1997 | Murray et al. | 347/85 |
| 5,745,137 | 4/1998 | Scheffelin et al. | 347/85 |
| 5,751,319 | 5/1998 | Robertson et al. | 347/85 |
| 5,760,801 | 6/1998 | Jackson et al. | 347/29 |
| 5,801,735 | 9/1998 | Lorenze, Jr. et al. | 347/85 |
| 6,007,190 | 12/1999 | Murray et al. | 347/86 |

FIG. 6
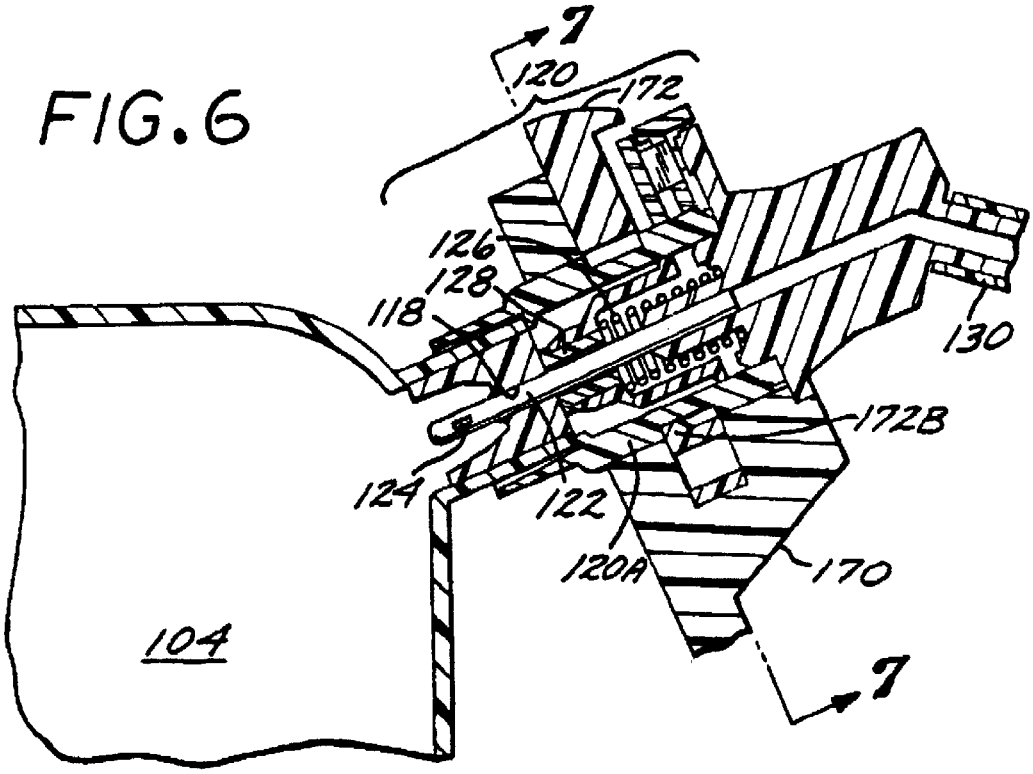
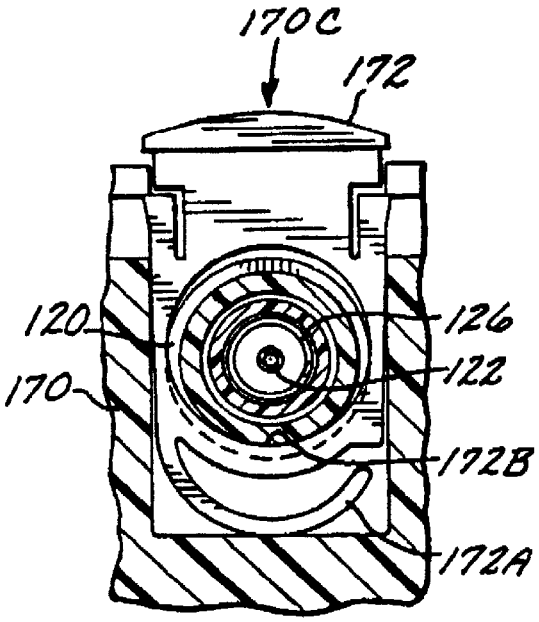
FIG. 7
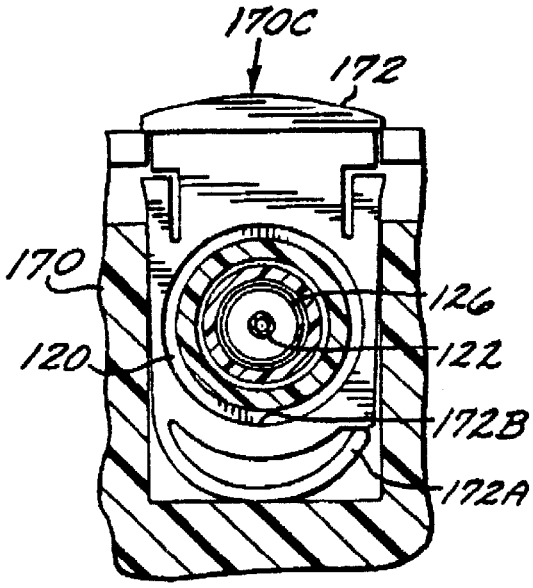
FIG. 8

FIG. 15
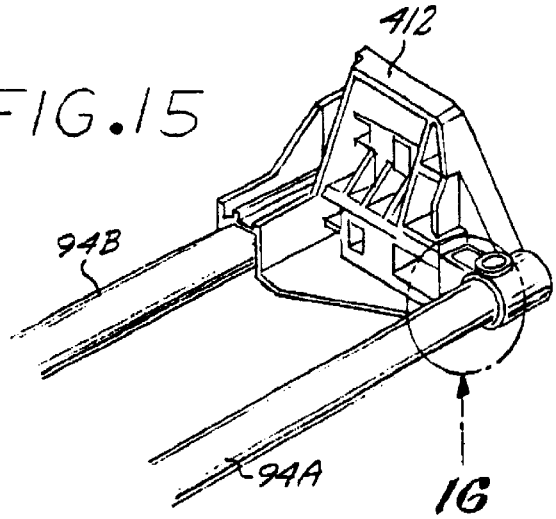
FIG. 16
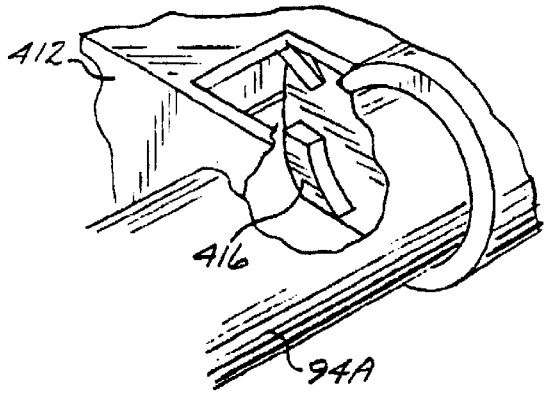
FIG. 17
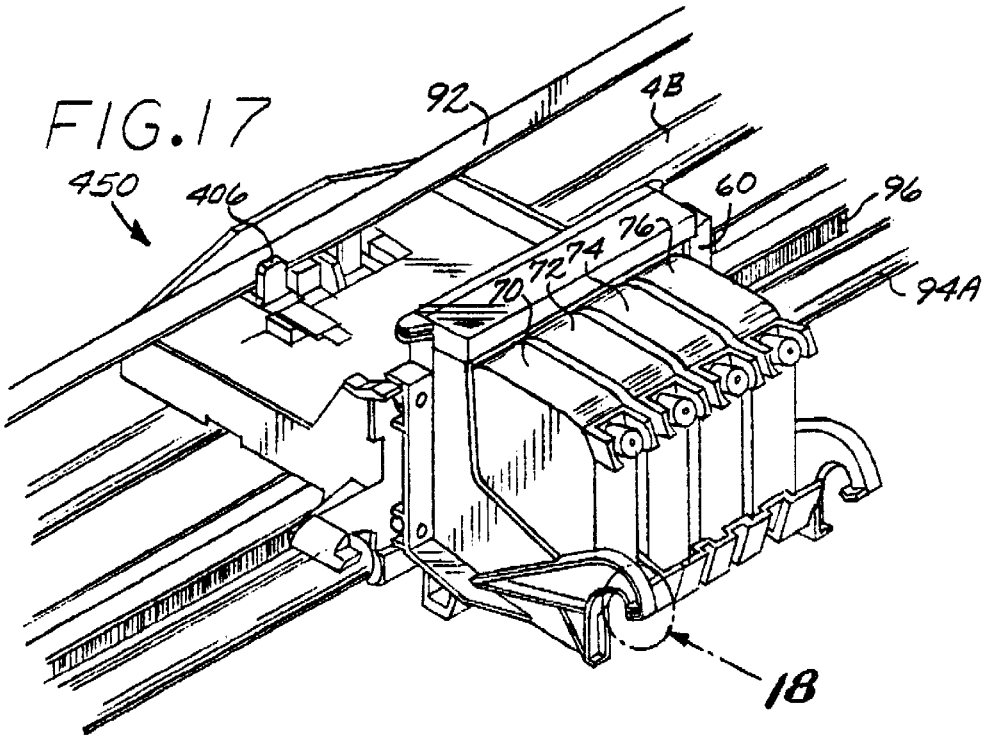
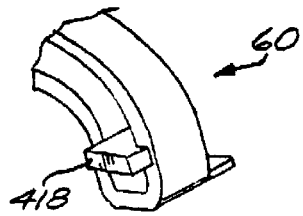
FIG. 18

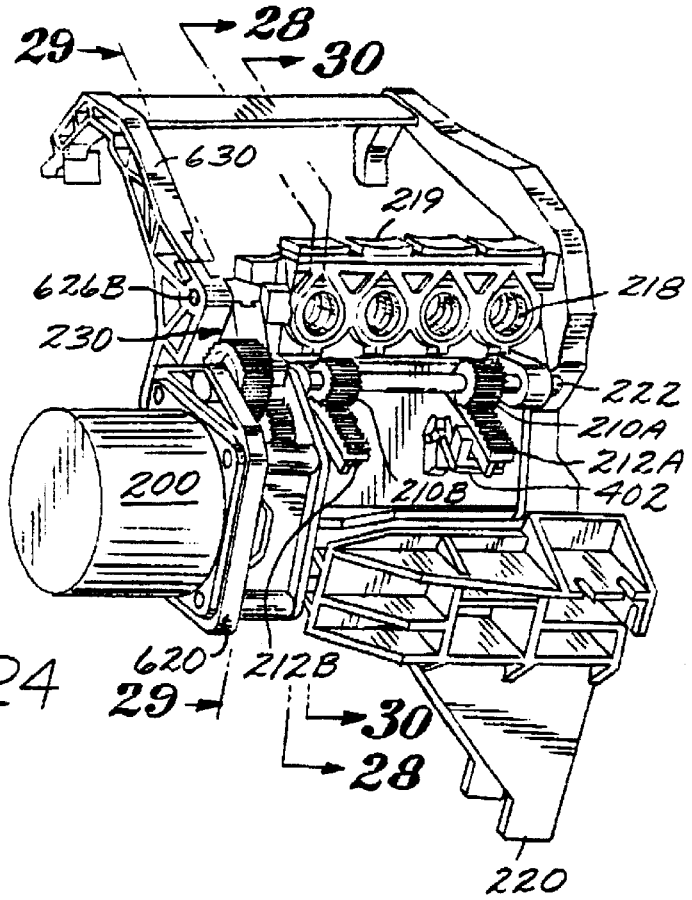
FIG. 24
FIG. 25
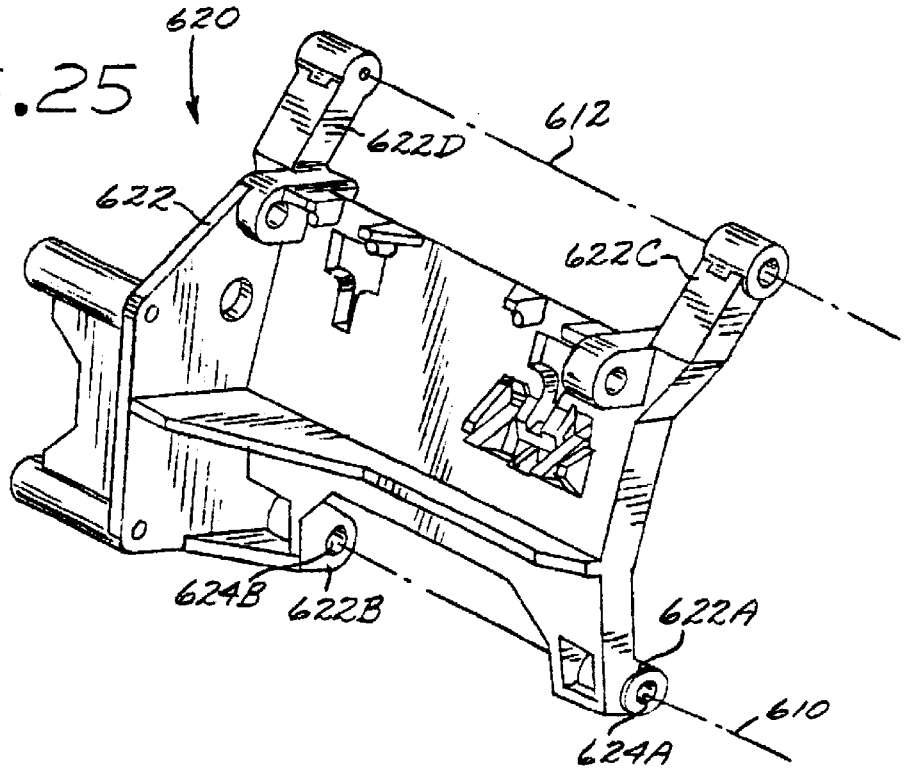

FIG. 30
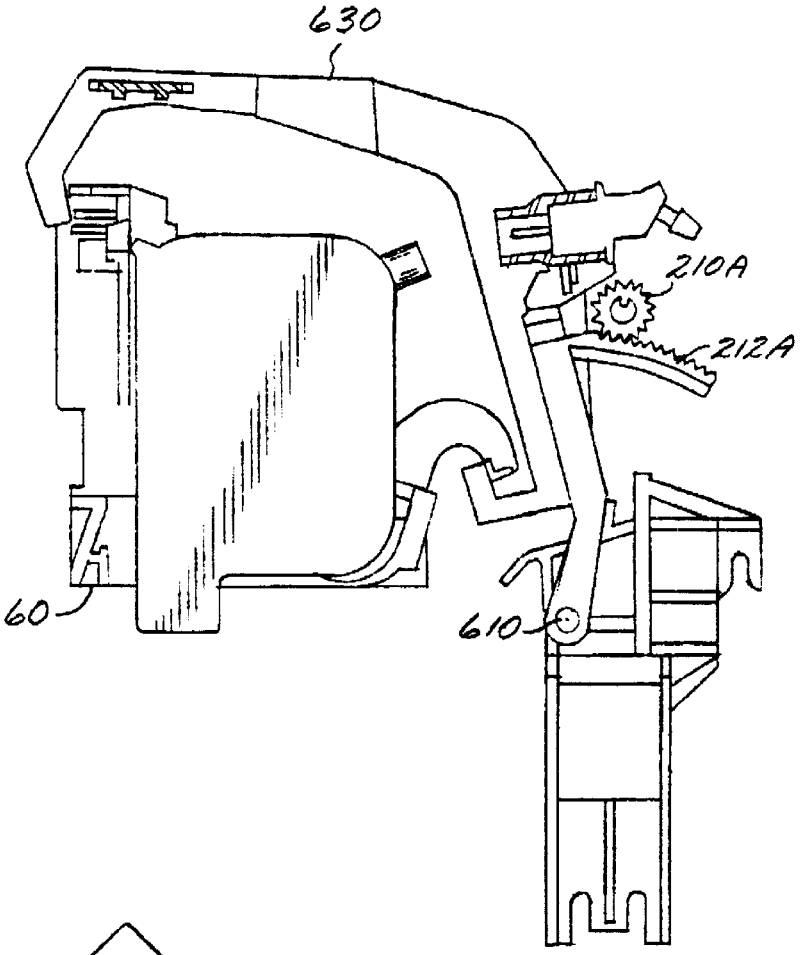
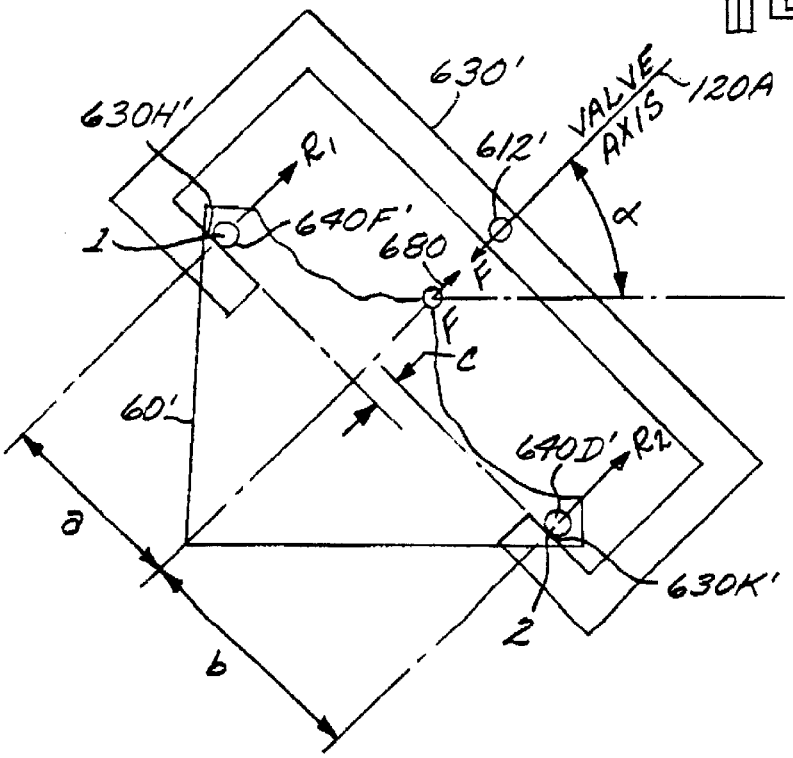
FIG. 32

PRINTER CARRIAGE ALIGNMENT FOR PERIODIC INK REPLENISHMENT FROM OFF-CARRIAGE INK SUPPLY

CROSS-REFERENCE TO RELATED APPLICATIONS

This application is a continuation-in-part of application Ser. No. 08/805,861, filed Mar. 3, 1997, now U.S. Pat. No. 6,106,109 and entitled PRINTER APPARATUS FOR PERIODIC AUTOMATED CONNECTION OF INK SUPPLY VALVES WITH MULTIPLE INKJET PRINTHEADS, by Ignacio Olazabal et al., the entire contents of which are incorporated herein by this reference.

This application is related to the following commonly assigned, co-pending applications, the entire contents of which are incorporated herein by this reference:

U.S. application Ser. No. 08/805,860, filed Mar. 3, 1997, SPACE-EFFICIENT ENCLOSURE SHAPE FOR NESTING TOGETHER A PLURALITY OF REPLACEABLE INK SUPPLY BAGS, by Erich Coiner et al.

U.S. application Ser. No. 09/032,340, filed Feb. 27, 1998, AUTOMATIC SINGLE MOTOR CONTROL OF BOTH CARRIAGE STABILIZATION AND VALVE ENGAGEMENT/DISENGAGEMENT FOR PRINTHEAD REPLENISHMENT FROM SUPPLEMENTAL INK SUPPLY, by Ignacio de Olazabal.

U.S. application Ser. No. 09/032,746, filed Feb. 27, 1998, CARRIAGE STABILIZATION DURING PERIODIC VALVE ENGAGEMENT FOR PRINTHEAD REPLENISHMENT, by Joaquim Veciana et al.

TECHNICAL FIELD OF THE INVENTION

This invention relates to ink-jet printers/plotters, and more particularly to techniques for periodic ink replenishment of printheads at a refill station.

BACKGROUND OF THE INVENTION

A printing system is described in the commonly assigned patent application entitled "CONTINUOUS REFILL OF SPRING BAG RESERVOIR IN AN INK-JET SWATH PRINTER/PLOTTER," Ser. No. 08/454,975, filed May 31, 1995, (the '975 application) which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality. While this system has many advantages, there are some applications in which the relatively permanent connection of the off-carriage and on-carriage reservoirs via tubing is undesirable.

A new ink delivery system (IDS) for printer/plotters has been developed, wherein the on-carriage spring reservoir of the print cartridge is only intermittently connected to the off-carriage reservoir to "take a gulp" and is then disconnected from the off-carriage reservoir. No tubing permanently connecting the on-carriage and off-carriage elements is needed. The above-referenced related applications describe certain features of this new ink delivery system and the refill station.

SUMMARY OF THE INVENTION

In accordance with an aspect of the invention, a method is described for aligning a carriage holding a pen in a printing machine including a carriage axis assembly including the carriage, a motor drive system for moving the carriage along a carriage axis, a carriage position sensor, and a refill station disposed along the axis. One embodiment of the method includes the steps of:

determining a carriage alignment position of the carriage alignment method at which the pen septum is aligned with the refill valve during an alignment process, the alignment process including (i) actuating the motor drive system to move the carriage in a first direction along the carriage axis to a first end of carriage travel along the carriage axis, (ii) sensing the position of the carriage at the first end of carriage travel, and storing the sensed first end position, (iii) actuating the motor drive system to move the carriage in a second direction along the carriage axis until the carriage runs into contact with a refill stopper surface of the refill station, (iv) determining a refill stopper carriage position at which the carriage runs into the refill stopper surface, and (v) determining the alignment position from the refill stopper carriage position;

moving the carriage along the carriage axis during printing operations and dispensing droplets of liquid ink from the printhead onto a print medium; and conducting a refill operation by moving the carriage to the alignment position, engaging the pen septum and the refill valve to provide a fluid path through the refill valve and the pen septum, passing ink through the refill valve and the pen septum to refill the pen, and disengaging the refill valve from the pen septum.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is a cross-sectional view similar to FIG. 5, but showing the valve structure in an engaged position relative to the refill port of the print cartridge.

FIG. 7 is a cross-sectional view taken along line 7—7 of FIG. 6 and showing structure of the needle valve and locking structure for locking the valve in the refill socket at the refill station.

FIG. 8 is a cross-sectional view similar to FIG. 7, showing the lock in a released position.

FIG. 10 shows the valve structure in a disengaged position. FIG. 11 shows the valve structure moved into an engaged position.

FIG. 15 is an isometric view of the right portion of the carriage axis assembly of FIG. 13.

FIG. 16 is a expanded scale, partially broken-away view of the area noted in circle 16 in FIG. 15.

FIG. 17 is a close-up isometric view of the printer carriage.

FIG. 18 is a expanded scale, partially broken-away view of the area noted in circle 18 in FIG. 17.

FIG. 24 is a reverse direction isometric view of the refill station in isolation.

FIG. 25 is an isometric view of the refill station frame.

FIG. 30 is a side sectional view taken along line 30—30 of FIG. 24.

FIG. 32 is a simplified conceptual diagram showing the balancing of clamping forces and pen engagement forces.

DETAILED DESCRIPTION OF THE PREFERRED EMBODIMENT

Figure 1:
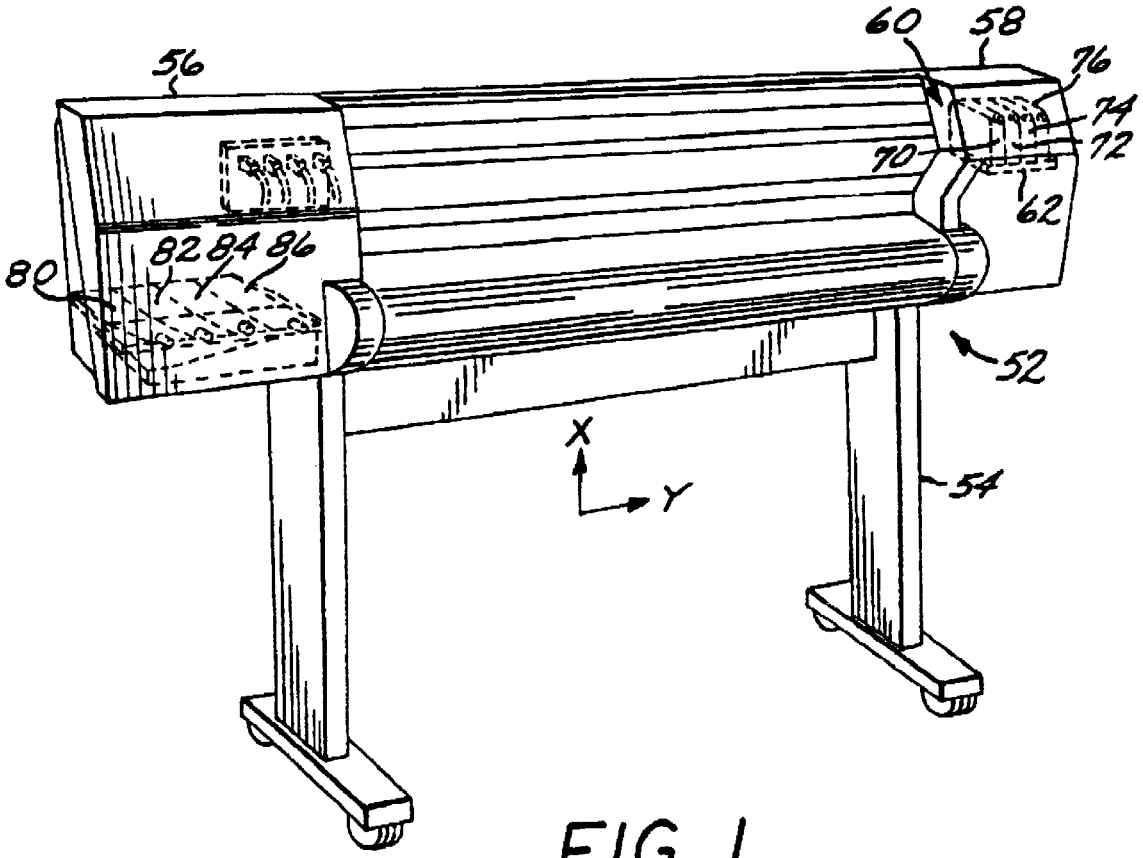
FIG. 1 is an isometric view of a large format printer/plotter system employing the invention.

An exemplary application for the invention is in a swath plotter/printer for large format printing (LFP) applications. FIG. 1 is a perspective view of a thermal ink-jet large format printer/plotter 50. The printer/plotter 50 includes a housing 52 mounted on a stand 54 with left and right covers 56 and 58. A carriage assembly 60 is adapted for reciprocal motion along a carriage slide rod. A print medium such as paper is positioned along a media axis by a media axis drive mechanism (not shown). As is common in the art, the media drive axis is denoted as the 'x' axis, the carriage scan axis is denoted as the 'y' axis, and the 'z' axis is oriented vertically.

Figure 3:
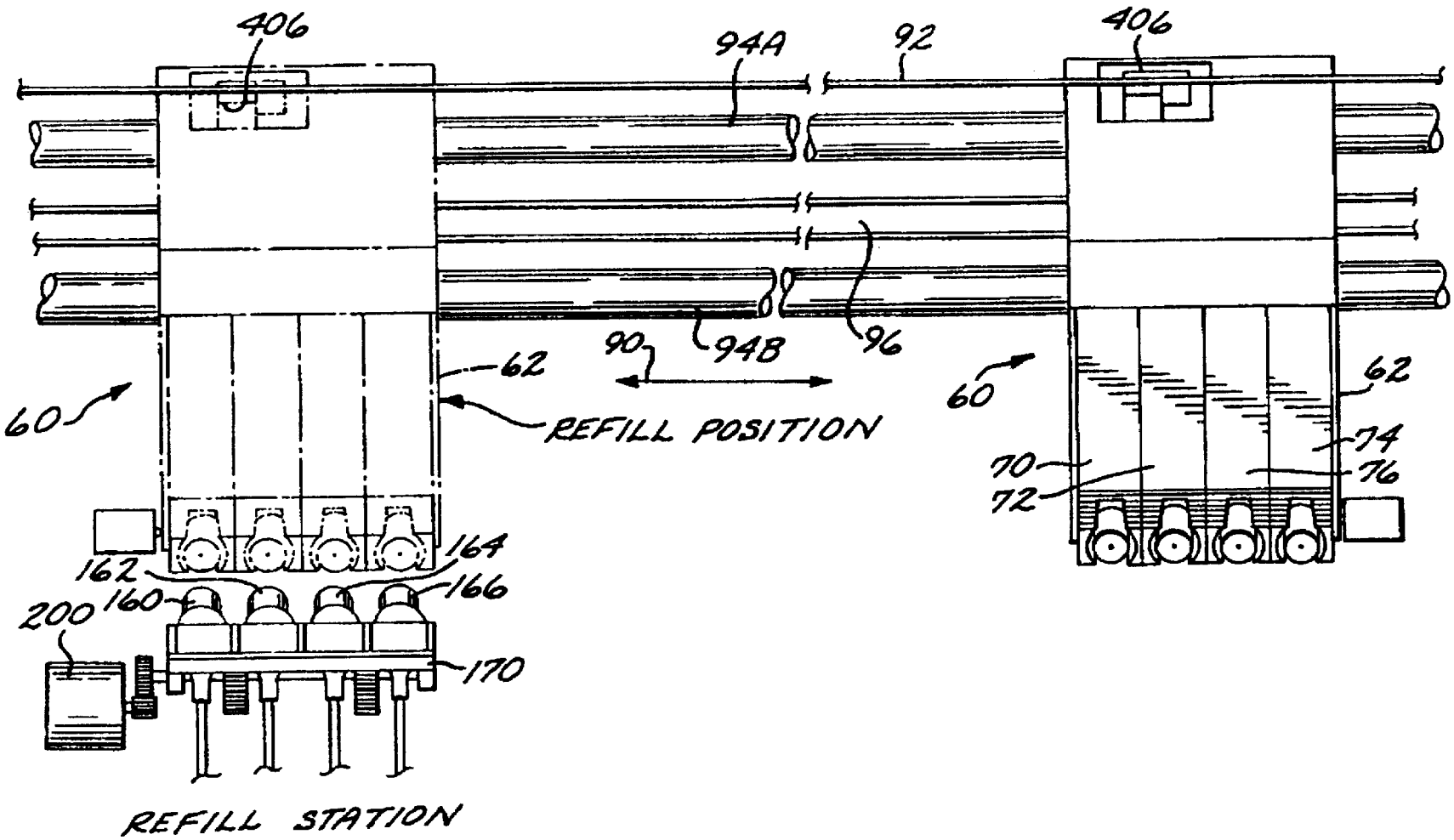
FIG. 3 is a top view showing the printer carriage and refill station.
Figure 4:
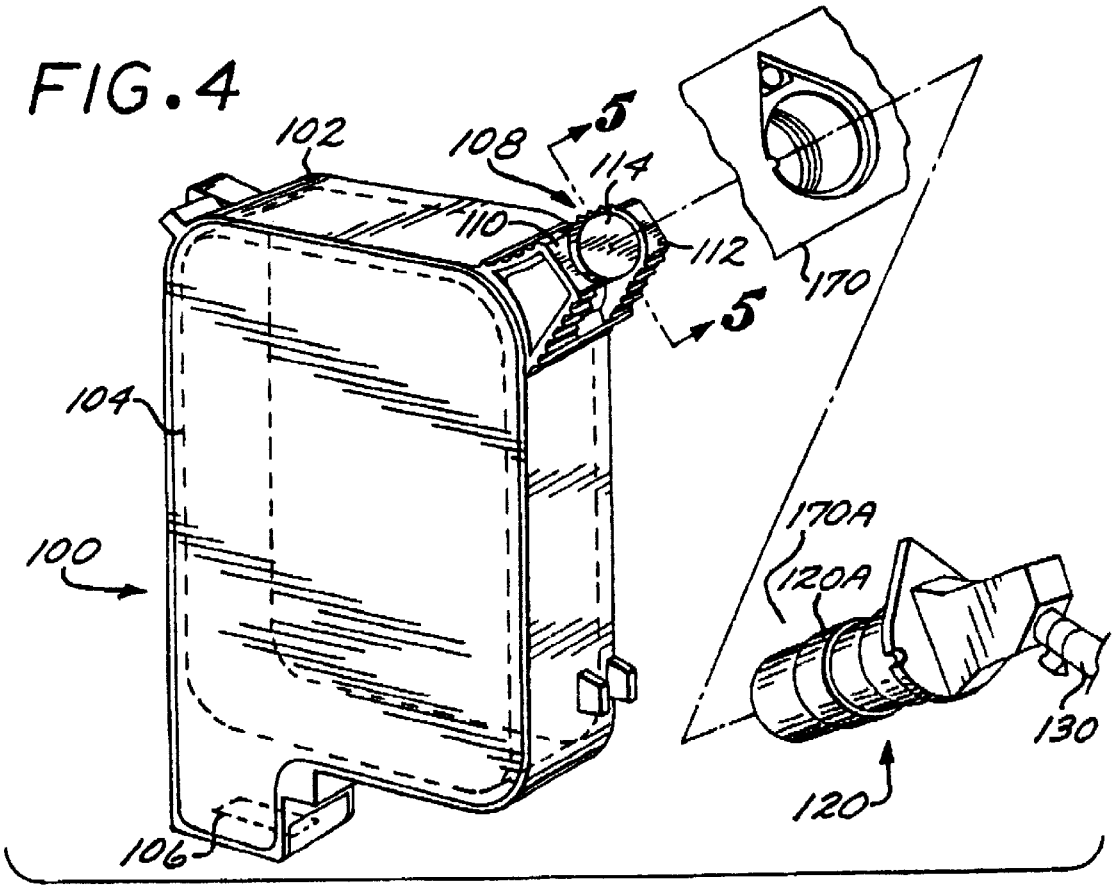
FIG. 4 is an isometric view of an ink-jet print cartridge usable in the system of FIG. 1, with a refill arm portion, a needle valve, and supply tube in exploded view.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis is determined by a carriage positioning mechanism with respect to an encoder strip 92. The carriage positioning mechanism includes a carriage position motor 404 (FIG. 12) which drives a belt 96 attached to the carriage assembly. The position of the carriage assembly along the scan axis is determined precisely by the use of the encoder strip. An optical encoder 406 (FIG. 12) is disposed on the carriage assembly and provides carriage position signals which are utilized to achieve optimal image registration and precise carriage positioning. Additional details of a suitable carriage positioning apparatus are given in the above-referenced '975 application.

The printer 50 has four ink-jet print cartridges 70, 72, 74, and 76 that store ink of different colors, e.g., yellow, cyan, magenta and black ink, respectively, in internal spring-bag reservoirs. As the carriage assembly 60 translates relative to the medium along the y axis, selected nozzles in the ink-jet cartridges are activated and ink is applied to the medium.

The carriage assembly 60 positions the print cartridges 70–76, and holds the circuitry required for interface to the heater circuits in the cartridges. The carriage assembly includes a carriage 62 adapted for the reciprocal motion on the front and rear sliders 92A, 92B. The cartridges are secured in a closely packed arrangement, and may each be selectively removed from the carriage for replacement with a fresh pen. The carriage includes a pair of opposed side walls, and spaced short interior walls, which define cartridge compartments. The carriage walls are fabricated of a rigid engineering plastic. The print heads of the cartridges are exposed through openings in the cartridge compartments facing the print medium.

As mentioned above, full color printing and plotting requires that the colors from the individual cartridges be applied to the media. This causes depletion of ink from the internal cartridge reservoirs. The printer 50 includes four take-a-gulp IDSs to meet the ink delivery demands of the printing system. Each IDS includes three components, an off-carriage ink reservoir, an on-carriage print cartridge, and a print head cleaner. The ink reservoir includes a bag holding 370 ml of ink, with a short tube and refill valve attached. Details of a ink reservoir bag structure suitable for the purpose are given in co-pending application Ser. No. 08/805,860 filed Mar. 3, 1997, SPACE-EFFICIENT ENCLOSURE SHAPE FOR NESTING TOGETHER A PLURALITY OF REPLACEABLE INK SUPPLY BAGS, by Erich Coiner et al. These reservoirs are fitted on the left-hand side of the printer (behind the door of the left housing 58) and the valves attach to a valve holder arm 170, also behind the left door, as will be described below. The print cartridge in this exemplary embodiment includes a 300-nozzle, 600 dpi printhead, with an orifice through which it is refilled. The head cleaner (not shown) includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four print cartridges 70–76 simultaneously when any one of the print cartridge internal reservoir's ink volume has dropped below a threshold value. A refill sequence is initiated immediately after completion of the print that caused the print cartridge reservoir ink volume to drop below the threshold and thus a print should never be interrupted for refilling (except when doing a long-axis print that uses more than 15.5 ccs of ink of any color).

The '975 application describes a negative pressure, spring-bag print cartridge which is adapted for continuous refilling. FIGS. 4–8 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 70–76 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a printing operation. A protruding grip 108 extends from the housing enabling convenient installation and removal from a print carriage within an ink-jet printer. The grip is formed on an external surface of the housing.

Figure 5:
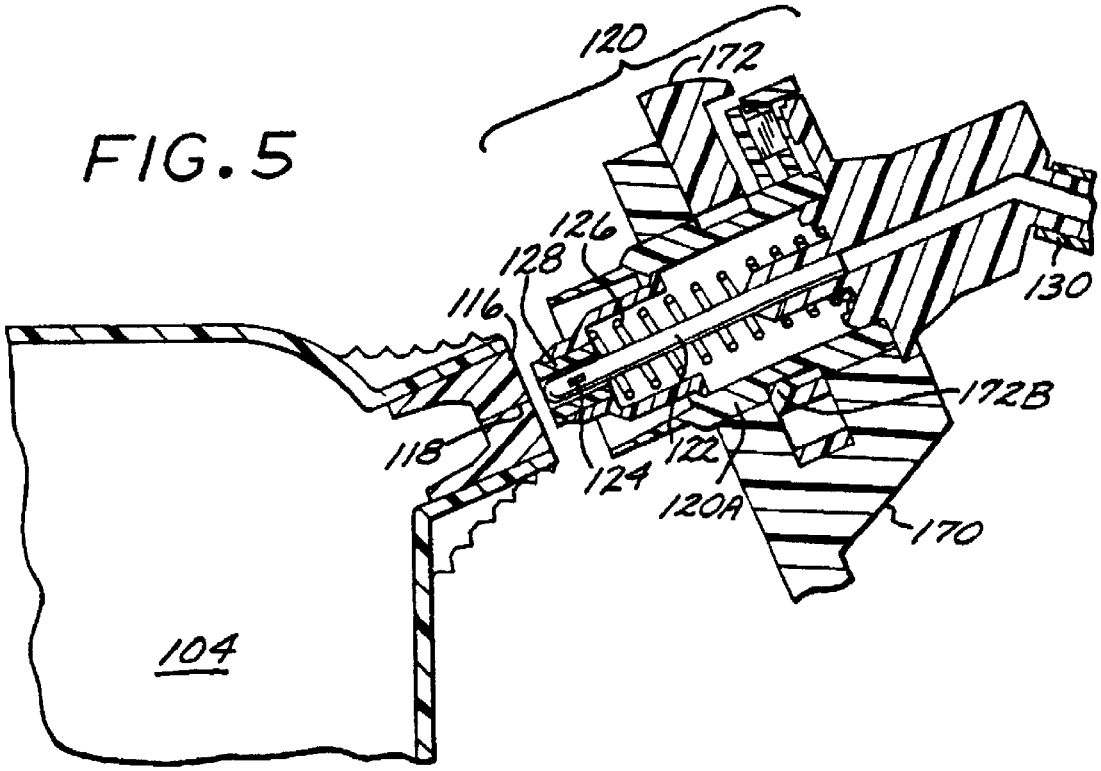
FIG. 5 is a cross-sectional view taken along line 5—5 of FIG. 4, showing the valve structure in a disengaged position relative to a refill port on the print cartridge.
Figure 9:
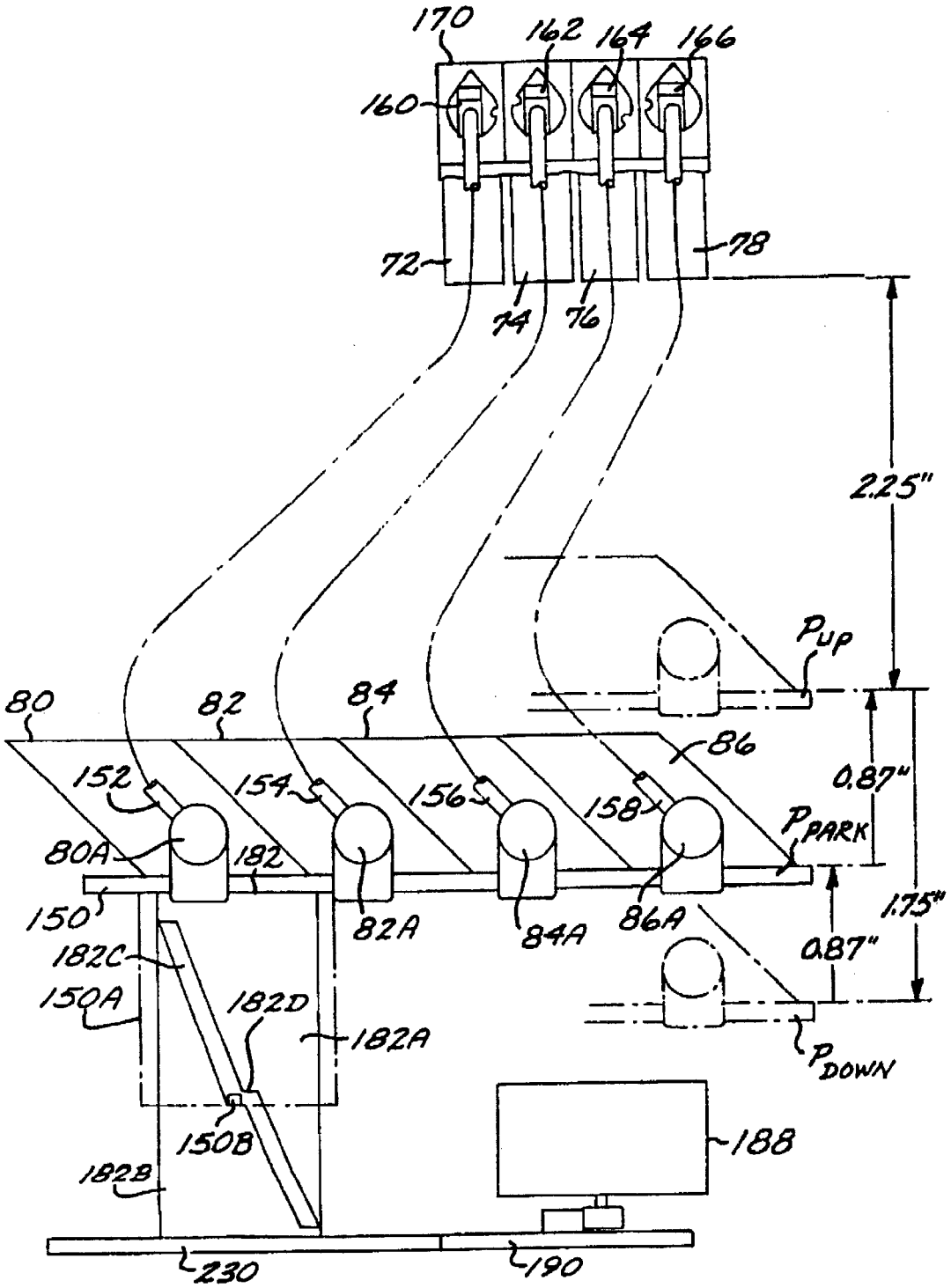
FIG. 9 is a simplified front plan view showing elements of the ink refill station, and with the reservoir platform at different heights.

FIGS. 5–8 show additional detail of the grip 108. The grip includes two connectors 110, 112 on opposing sides of a cylindrical port 114 which communicates with the reservoir 104. The port is sealed by a septum 116 formed of an elastomeric material. The septum 116 has a small opening 118 formed therein. The grip with its port 114 is designed to intermittently engage with a needle valve structure 120 connected via a tube 122 to an off-carriage ink reservoir such as one of the reservoirs 80–86 of the system of FIG. 1. FIG. 5 shows the valve structure 120 adjacent but not engaged with the port 116. FIG. 6 shows the valve structure 120 fully engaged with the port. As shown in FIG. 6, the structure 120 includes hollow needle 122 with a closed distal end, but with a plurality of openings 124 formed therein adjacent the end. A sliding valve humidor 128 tightly fits about the needle, and is biased by a spring 126 to a valve closed position shown in FIG. 5. When the structure 120 is forced against the port 116, the humidor is pressed up the length of the needle, allowing the needle tip to slide into the port opening 118, as shown in FIG. 6. In this position, ink can flow through the needle openings 124 between the reservoir 104 and the tube 130. Thus, with the cartridge 100 connected to an off-carriage ink reservoir via a valve structure such as 120, a fluid path is established between the print cartridge and the off-carriage reservoir. Ink can flow between the off-carriage ink reservoir to the cartridge reservoir 104. When the structure 120 is moved away from the handle 108, the valve structure 120 automatically closes as a result of the spring 126 acting on the humidor 128. The opening 118 will close as well due to the elasticity of the material 116, thereby providing a self-sealing refill port for the print cartridge.

FIGS. 4–8 illustrate a locking structure 172 for releasably locking the valve 120 into the valve holder arm 170 at socket 174. The structure 172 has locking surfaces 172B (FIG. 5) which engage against the outer housing of the valve body 120A. The structure is biased into the lock position by integral spring member 172A (FIGS. 7 and 8). By exerting force on 172 at point 170C (FIGS. 7 and 8) the spring is compressed, moving surface 172B out of engagement with the valve body, and permitting the valve to be pulled out of the refill arm socket 174. This releasing lock structure enables the valve and reservoir to be replaced quickly as a unit.

The print cartridges 70–76 in this exemplary embodiment each comprise a single chamber body that utilizes a negative pressure spring-bag ink delivery system, more particularly described in the '975 application.

The off-carriage ink reservoirs 80–86 are placed on a variable height refill platform 150, which can place the off-carriage reservoirs at an up position. At this position, with increased pressure head at the reservoir due to its elevated position, the print cartridge reservoir will refill. To prevent a print cartridge vacuum pressure which is too low to provide high quality printing, the position of the off-carriage reservoir is subsequently lowered with respect to the printhead nozzles, allowing a small amount of ink, e.g. on the order of 1–3 cc of ink in an exemplary embodiment, to flow from the print cartridge reservoir 104 back through the refill tube 130 into the off-carriage reservoir. The refill valve structure 120 can then be disconnected from the cartridge refill port, and the printing system can proceed with printing operations with a print cartridge that has been refilled with ink.

The variable height refill platform 150 ensures that each off-carriage reservoir bag can be virtually depleted of ink, by moving the bag higher in relation to the printhead nozzles to increase the pressure head, thus maximizing the pressure differential that drives the flow in ink into the cartridges.

Figure 2:
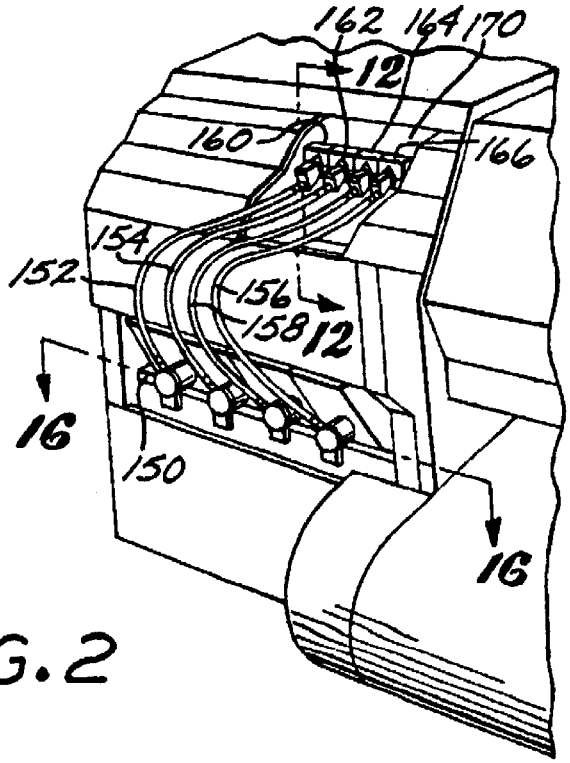
FIG. 2 is an enlarged view of a portion of the system of FIG. 1, showing the refill station.

In the exemplary system of FIG. 1, the refill platform 150 is in the left housing 56 of the printer 50 as shown in FIG. 2. A cam system 180 is employed to raise and lower the platform. A stepper motor 188 drives a gear train 190 to actuate the cam system.

The four off-carriage ink reservoirs 80–86 are supported on the platform 150. Short flexible tubes 150, 152, 154 and 156 connect between ports 80A–86A of corresponding reservoirs 80–86 and needle valve structures 160, 162, 164 and 166 supported at a valve holder arm 170. These needle valve structures each correspond to the valve structure 120 of FIGS. 4–8.

The refill platform 150 is an elevator that holds the four reservoirs and can be moved up and down by the stepper motor drive.

Figure 11:
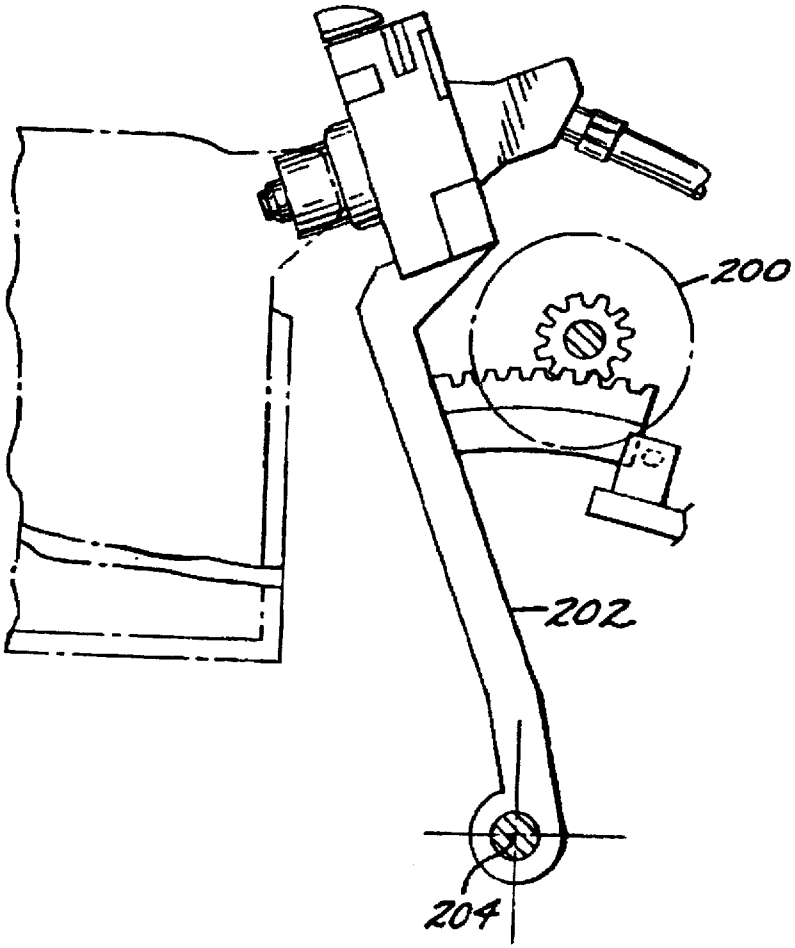
FIGS. 10 and 11 illustrate in simplified side view the mechanism for engaging and disengaging the valve structure from the print cartridge refill ports at the refill station.
Figure 10:
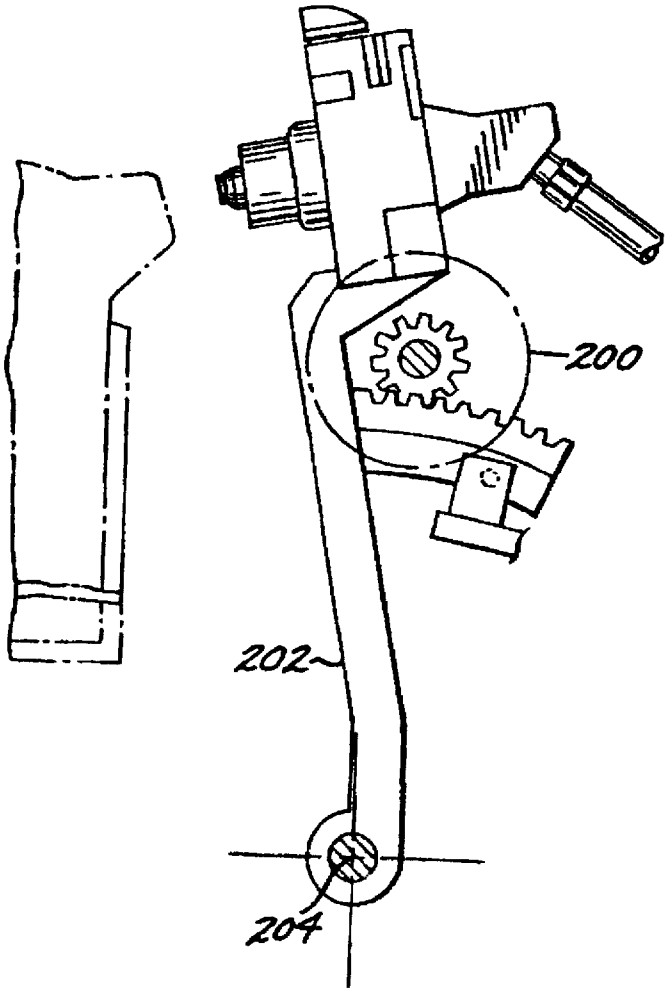

To perform a refill the carriage assembly 60 is moved to the refill station where the four off-carriage reservoirs 80–86 are connected to the corresponding print cartridges 70–76 via the shut-off valves 160–166. The above referenced pending application, U.S. application Ser. No. 08/810,840, filed Mar. 3, 1997 PRINTING SYSTEM WITH SINGLE ON/OFF CONTROL VALVE FOR PERIODIC INK REPLENISHMENT OF PRINTHEAD, by Max S. Gunther et al., provides additional details of the shut-off valves. Another form of shut-off valving suitable for the purpose is described in the above referenced pending application, U.S. application Ser. No. 08/726,587, filed Oct. 7, 1996, INKJET CARTRIDGE FILL PORT ADAPTER, Robert J. Katon et al. The connection of the reservoirs is accomplished by turning a stepper motor 200 that advances a valve support arm 202 that rotates on axle 209, and on which the valve structures and valve holder structure 170 are mounted, as shown in FIGS. 3 and 10–11. A system suitable for moving the valves into and out of engagement with the refill ports is more fully described below. While the valves are engaged in the refill ports of the print cartridges, ink is pulled into the print cartridge reservoir due to the slight vacuum pressure (back pressure) in it.

The entire sequence of the refill operation can be performed relatively quickly, e.g. an estimated total time for the refill operation of 180 seconds for this exemplary embodiment. This is a relatively short time period for the refill. Another advantage is that the refill can be performed without the need to remove and replace the print cartridges from the carriage, thus further contributing to the efficiency of the refill process. Yet another advantage is that all of the print cartridges are simultaneously replenished with ink during the refilling process, without removing the print cartridges from the carriage.

Figure 12:
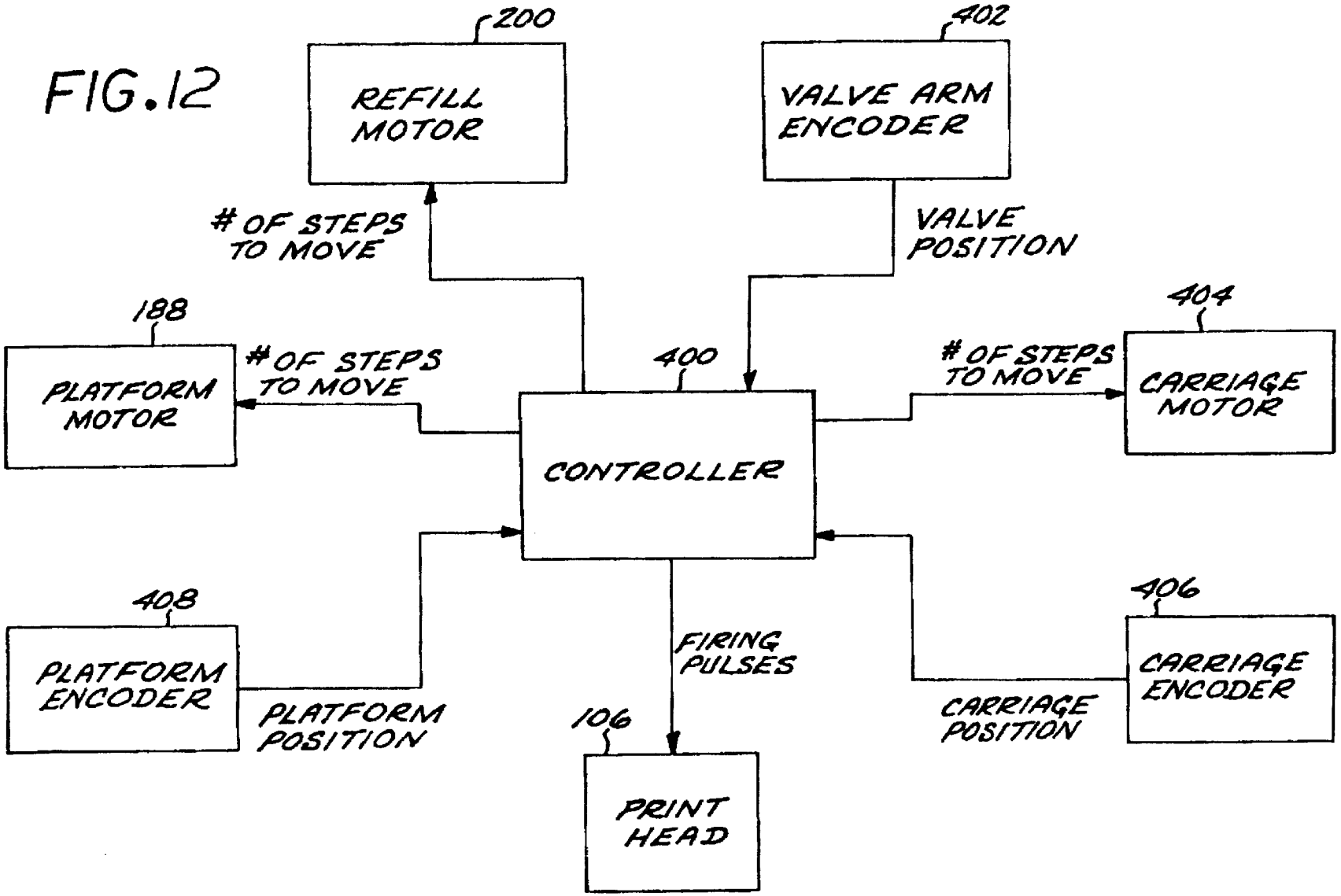
FIG. 12 is a simplified functional block diagram of the system controller and controlled elements of the printing system of FIG. 1.

FIG. 12 is a simplified functional block diagram showing the system controller 400 and various elements of the drive and control system. The controller 400 provides firing impulses to the firing chamber resistors of the printhead 106, and counts the number of drops fired for each color. The controller controls the carriage stepper drive motor 404, receiving carriage position data from a carriage encoder sensor 406. The controller also issues drive signals to the platform motor 188 and refill motor 200, receiving platform and valve position data from encoders 408 and 402.

The refill mechanism provides a concern during start up of the printer. Suppose that the power is inadvertently shut off during a refill and that the valves are still engaged in the printheads. It is prudent to assume that the valves will be engaged in the print cartridges for a long time. This implies that, upon startup and initialization, the carriage cannot be immediately moved, since the valves may still be engaged, and serious damage could occur. Additionally, since the print cartridges are assumed to be very full, since the machine has sat with valves engaged for a long time and the platform has not been moved down, the refill cycle needs to be completed by moving the platform down to remove ink and set the printhead back pressure. Thus, during startup, (1) the platform is moved to the down position to set the back pressure, then (2) the valves are disengaged. Lastly, refill servicing should be performed to ensure print cartridge health.

Carriage Alignment Technique

The plotter includes apparatus that provides motion to the ink-jet pens and locates them in order to provide good image quality. This apparatus includes the Y or carriage axis drive system and the carriage assembly, shown in the isometric view of FIG. 13 of the carriage axis assembly 450. The Y drive system provides an accurate motion to the carriage, in position and speed, and is robust against perturbations. The motion is provided by a motor-belt-tensioner system, held at each end of the carriage slider rods. The motor 404 is mounted at the left end of the assembly 450, to the left holder bracket 410. The left and right holder brackets 410, 412 is attached to the carriage slider rods 94A, 94B. The drive belt 96 is driven by the motor 404, and is reeved about pulleys (not shown) mounted in the holder brackets. The carriage 60 is secured to the drive belt 96, so that rotational motor movement is translated into linear motion of the carriage along the slider rods.

The system 50 also includes a machine chassis (not shown), which in an exemplary embodiment is an aluminum extrusion which is located under the slider rods 94A, 94B and between machine side plates (not shown), which provide stiffness to the carriage path in order to avoid deformations due to the weight of machine components or to other forces. The chassis also holds structural components of the machine.

The carriage motion speed and position are read by an optical encoder sensor 406, sensing lines on a linear encoder strip 92 attached to the plastic holder brackets 410, 412, and loaded with leaf springs. A suitable encoder system is described in U.S. Pat. No. 5,276,970, CODESTRIP IN A LARGE-FORMAT, IMAGE-RELATED DEVICE, the entire contents of which are incorporated herein by this reference. Electrical signals to and from the carriage are supported by a trailing cable, which leads to the machine controller 400.

The carriage 60 holds the removable pens 70–76 in stalls, and provides a correct position of the pens 70–76 in space, i.e. relative to each other and to the paper or print medium.

The carriage motion apparatus is susceptible to positioning errors due to dimensional tolerances. The encoder 92 has a very good resolution in position, referred to the side ends of the carriage path, which are sensed during initialization. However, any part attached to the machine side plates (e.g. side plate 602, FIG. 19) such as the refill station 600, or to the machine chassis have this reference through several parts that can add significant dimensional tolerances. These tolerances stack up, and depend not only on variability between machines, but also during machine life due to thermal effects, transportation shocks and the like. A refill-station-carriage alignment technique in accordance with an aspect of the invention reduces the effect of the stack of tolerances and variations during machine life, and achieves a very accurate positioning between the pen septum and the corresponding refill valve.

In an exemplary embodiment, the alignment technique refers the carriage 60 directly to the refill station (600), providing a travel stopper for the carriage directly on the refill station, and reducing to a minimum the number of parts involved in the tolerance stack. Physically this stopper includes two surfaces, one located on the carriage and the other located on the refill station, that bump against each other during an initialization sequence.

Figures 13, 14:
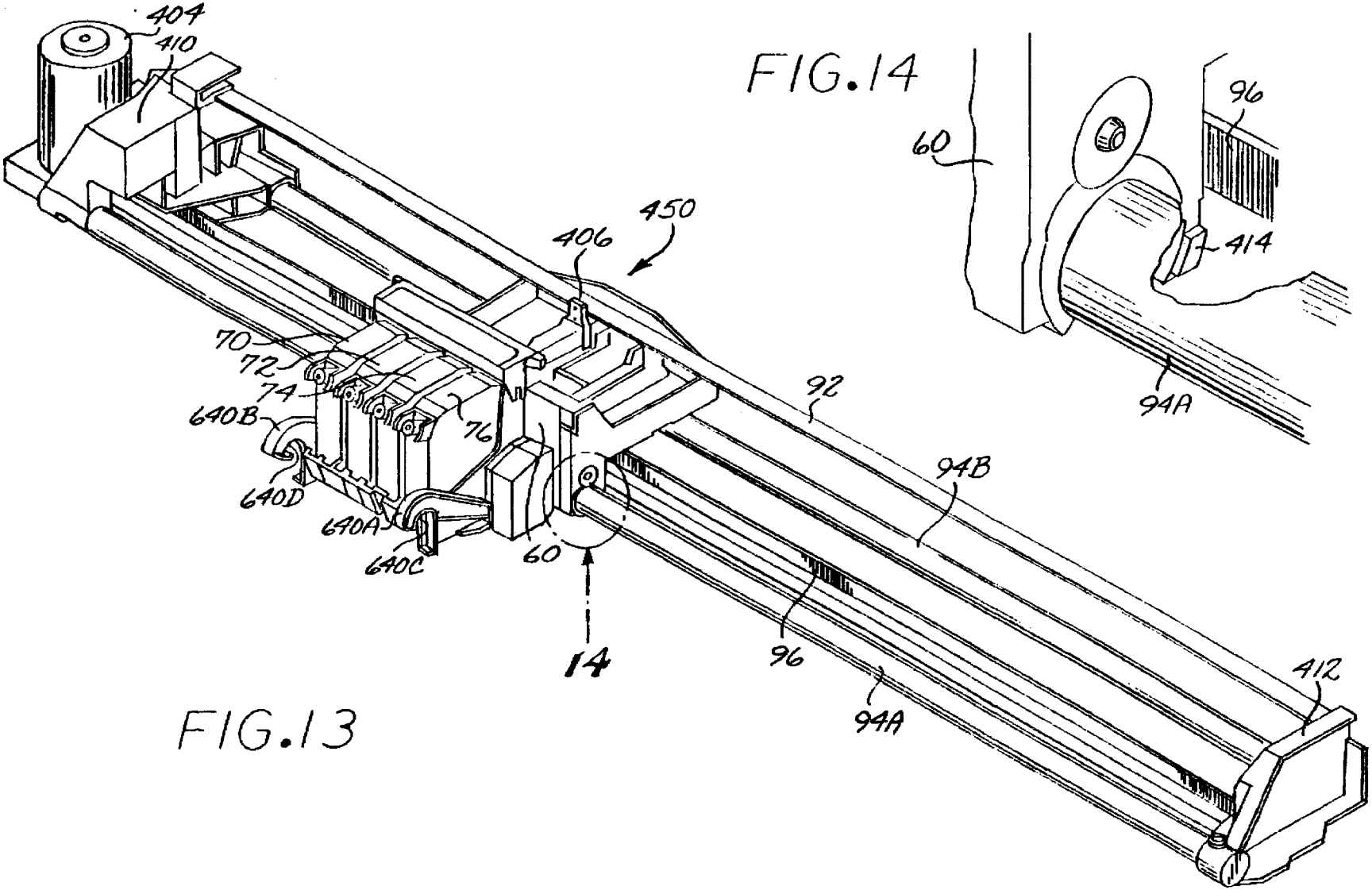
FIG. 13 is an isometric view of the carriage axis assembly of the printing system of FIG. 1.
FIG. 14 is a expanded scale, partially broken-away view of the area noted in circle 14 in FIG. 13.

The travel stoppers are shown in FIGS. 14–20. FIG. 14 is a expanded scale, partially broken-away view of the area noted in circle 14 in FIG. 13, and shows the carriage right side stopper surface 414, located on the carriage 60 directly adjacent the front slider rod 94A. The right holder stopper surface 416 is shown in the isometric view of FIG. 15, and more clearly in the expanded scale, partially broken-away view of FIG. 16. As the carriage 60 is driven to the right side, the respective right stopper surfaces 414 and 416 will come into contact. In this exemplary embodiment, the stopper surface 414 is a surface feature of the carriage 60, which is a molded plastic part fabricated of PPS with 15% carbon fiber, and the stopper surface 416 is a surface feature of the right holder 412, which also is a molded plastic part, fabricated of polycarbonate with 40% glass fiber.

Figure 19:
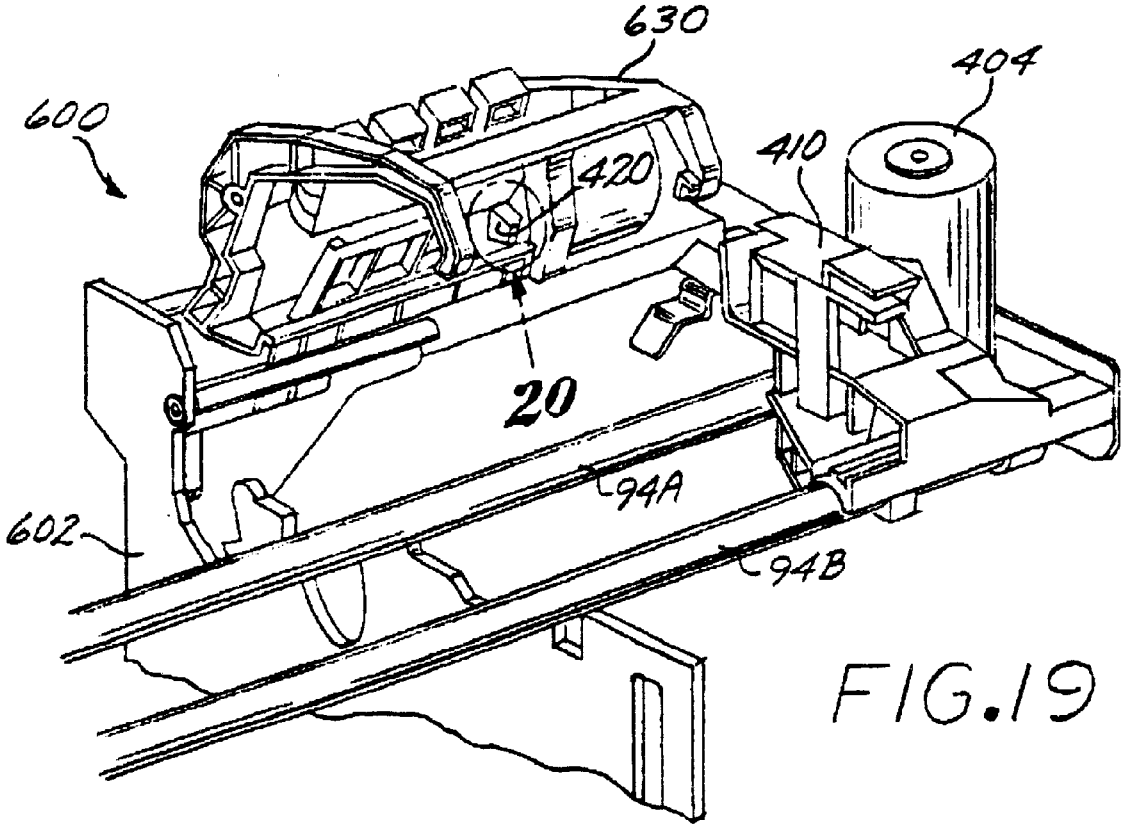
FIG. 19 is an isometric view of the left portion of the carriage axis assembly, with the refill station.
Figure 20:
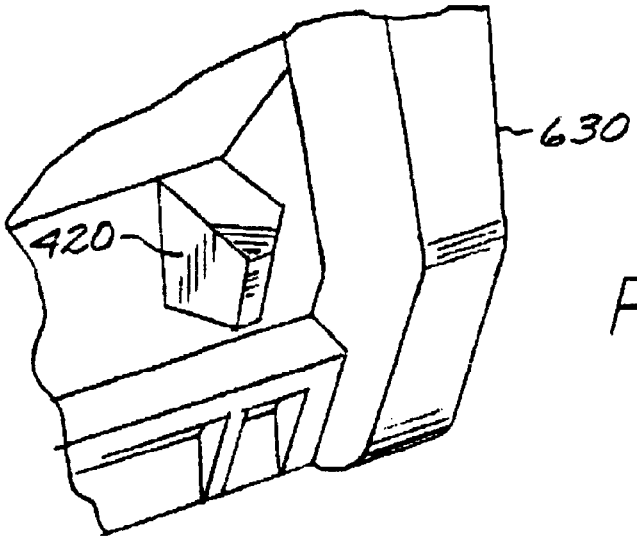
FIG. 20 is a expanded scale, partially broken-away view of the area noted in circle 20 in FIG. 19.

FIGS. 17–18 show the left, refill, side stopper surface 418 on the carriage 60. FIG. 17 is an isometric view of the carriage 60, with FIG. 18 an expanded scale view of the area noted as area 18 in FIG. 17. FIGS. 19–20 show the refill station stopper surface 420. The left side stopper surface 418 is a surface feature of the carriage; the refill station stopper surface 420 is a surface feature of the frame 630. As the carriage 60 is driven to the left side to the refill station, the respective stopper surfaces 418, 420 will come into contact.

The voltage applied to the Y axis motor 404 is controlled by a microprocessor controller 400, to control the speed and position of the carriage. This motor control is accomplished through a closed servo loop, with the feedback given by the carriage encoder 406 and encoder strip 92. When the carriage stops due to some reason, and the controller 400 is still ordering a movement, the controller 400 knows that the carriage is stopped through the feedback given by the encoder 406, and increases the voltage applied to the motor continuously, i.e., the controller increases the force applied to the carriage, until the carriage moves again or the voltage applied to the motor 404 reaches some established or fixed limit. As will be described below, there are two motor voltage limits of interest to this invention, a high voltage limit and a low voltage limit, which are used to sense the location of the stoppers.

The alignment technique includes an algorithm which uses values determined during the initialization sequence and a constant stored in the memory of the machine during the machine assembly process. In a general sense, the algorithm includes the following steps. Initialization commences when power to the machine is switched on. The carriage 60 is driven by the Y-axis motor drive system to make bumping contacts, i.e. "bumps," at both sides of its path, assigning to the right side the position value 0, and to the left side the position value read from the encoder that corresponds to the full length of the carriage path. The bumps are made in two sequences on each side. A strong bump is made by applying a high voltage limit to the motor 404 to overcome any relatively high friction caused by dust or dirty sliders, or by the media cutter (not shown) being out of its position. The cutter is disposed at the left (refill) side of the carriage assembly, and is parked at a refill stop position. However, if someone or something moves it out of its position, the carriage must move it to its parked position during initialization, using a high motor 404 drive voltage, since the cutter has relatively high friction. The position of the heavy bump stop is read by the encoder and stored in memory. Once the carriage path is clean, i.e. after the strong bump, another bump, a fine or light bump is made by applying a low voltage limit. The position of the fine bump is read by the encoder and stored in memory. The second bump contact is sensed using the fine motor voltage limit in order to avoid any deformation or movement of any part, and the position of the fine bump is used to refer all positions of the printer/plotter. However, as a protection against malfunction, if the difference in position between the strong bump position and the fine bump position is bigger than a limit threshold value, the machine gives a system error notification to the customer.

At the right side, the bump contact is made against the holder 412 which is solidly fixed to the slider rods 94A, 94B, and is given the reference value of 0. At the left side, at the refill station, the "LEFT STOP POSITION" is given by a stopper referenced to the refill station and not to the left holder. The right reference position, set to a 0 value, is used to refer several items on the machine, including the service station location, the paper edge detection, platen roller angular position mark.

Once the machine is initialized, the controller knows the position of the refill mechanism, and is able to refer to any feature of it with very small error. The alignment between the pen septums and the refill valves is given by a constant distance K1 stored in the machine memory during assembly. This constant is the distance between the "LEFT STOP POSITION" and the "ALIGNMENT POSITION." Thus, each time the carriage is driven to the refill station, it will be positioned at the "LEFT STOP POSITION" minus K1. If the machine during its life changes this "LEFT STOP POSITION" because of thermal effects, shock during transportation or other perturbation, the system is able to align with accuracy because the refill position sensed during each initialization upon power up.

Figure 21A:
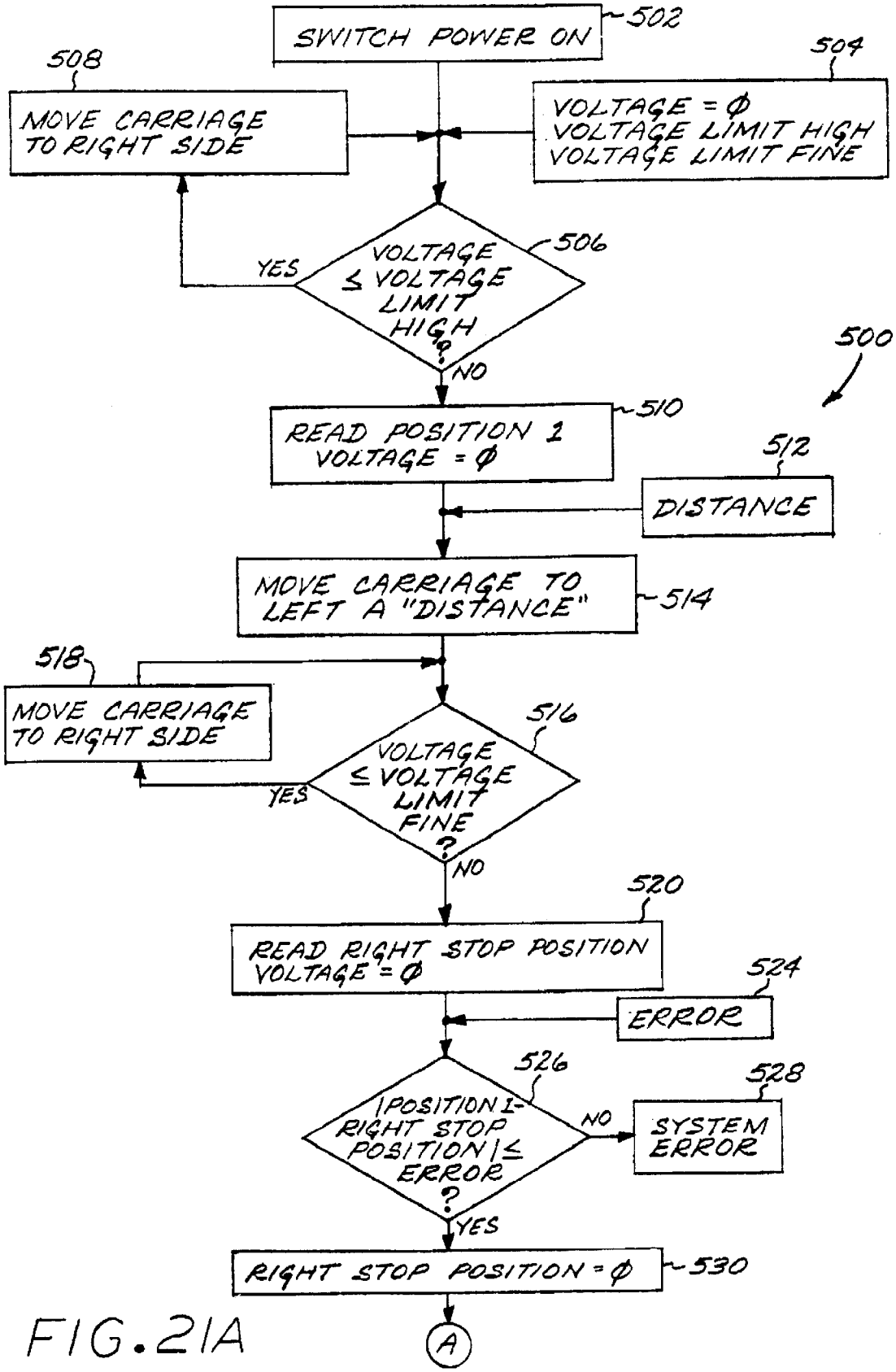
FIGS. 21A–21B are process flow diagrams illustrating an embodiment of a carriage alignment process.
Figure 21B:
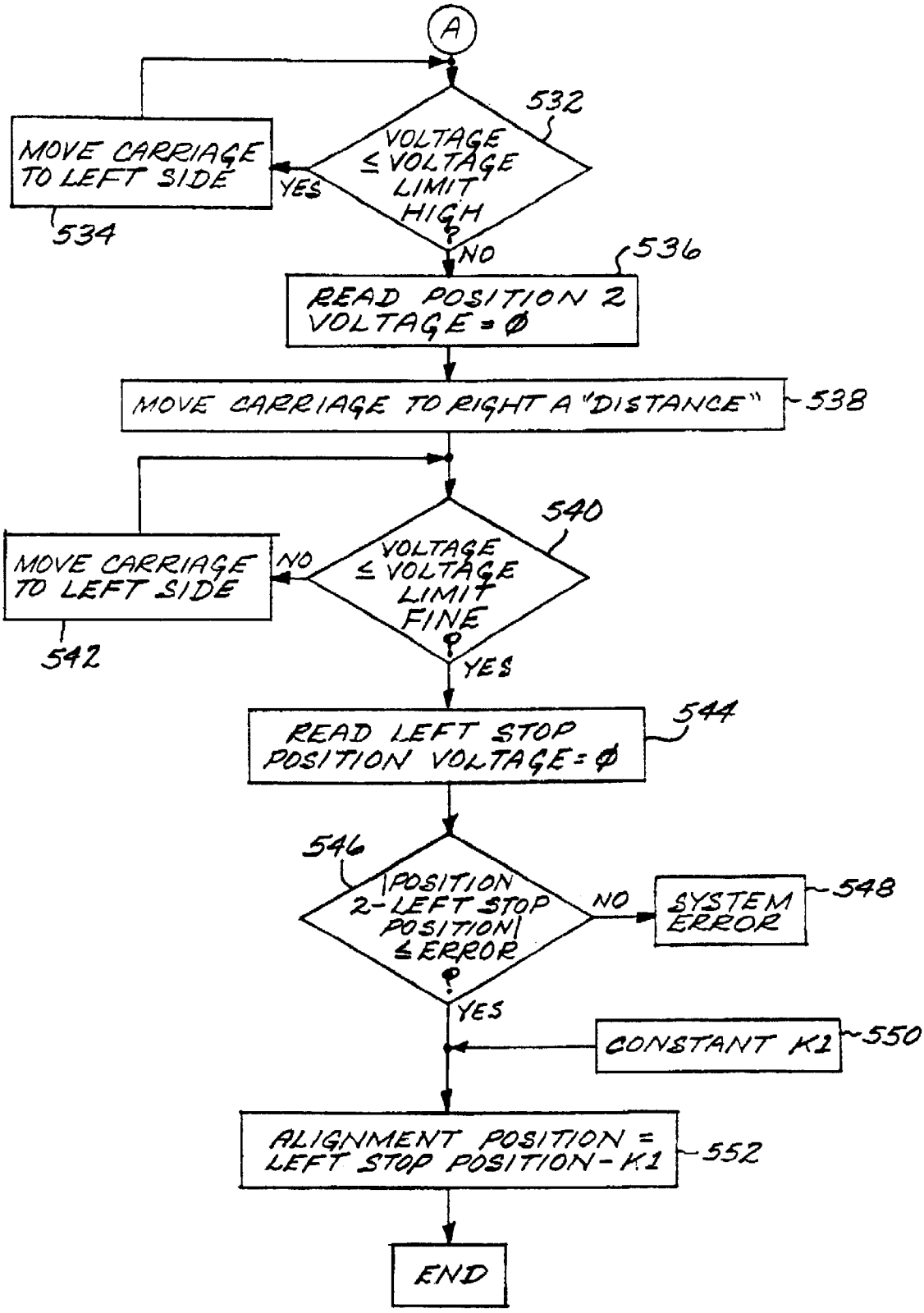

An exemplary embodiment of the alignment algorithm 500 is shown in the flow diagrams of FIGS. 21A–21B. The algorithm commences upon powering the machine up, at 502. An initial parameter set is read by the algorithm at 504, setting the voltage equal to 0, and the values of the high voltage limit and the fine voltage limit. The right side strong bump movement is carried out by steps 506–508, with the controller 400 determining the position of the carriage, i.e. "position 1," when the carriage has been stopped, and the motor voltage reaches the high voltage limit. Position 1 is read and stored in the machine memory, and the motor 404 voltage set to 0 at step 510.

At step 512, the algorithm reads a distance parameter value, and at step 514, starting from the right stop position, the carriage is moved left an amount equal to the distance parameter value. Now the right side fine bump takes place, in steps 516–518. The motor 404 is controlled to move the carriage to the right, until the carriage contacts the stopper, and the motor voltage reaches the fine voltage limit. The position of the carriage 60 at this point, the right stop position, is read, and the voltage is set to 0 at step 520. At step 524, the algorithm reads an error parameter value. At step 526, the magnitude of the position 1 stored value minus the stored value for the right stop position is compared to the error value. If the magnitude is not less than the error, a system error is declared at 528, and the machine operator is notified by an error message, e.g. on the machine display. If the magnitude is less than the error, then the right stop position is set to 0, and the motor voltage is set to 0 at step 530.

Next, the left side strong bump is carried out at steps 532–534, with the carriage being moved to the left side, until the left stopper is contacted and the high motor voltage limit is reached. At 536, the encoder position is read at position 2, and the motor voltage is set to 0. The carriage is then moved right (step 538) by the distance input at step 512. The left fine bump is then carried out at steps 540–542. When the carriage is stopped by contact with the left stopper, and the motor drive voltage reaches the fine voltage limit, the LEFT STOP POSITION value is read by the encoder, and the motor voltage set to 0 at step 544. The error parameter value is then compared to the magnitude of the position 2 value minus the left stop position, and if the magnitude is not less than or equal to the error, a system error is declared at 548. If the magnitude is less than the error value, the algorithm reads a constant K1 at 550, and at step 552, sets the alignment position to LEFT STOP POSITION−K1. The algorithm is then completed until the next time the machine is powered up.

Figure 22:
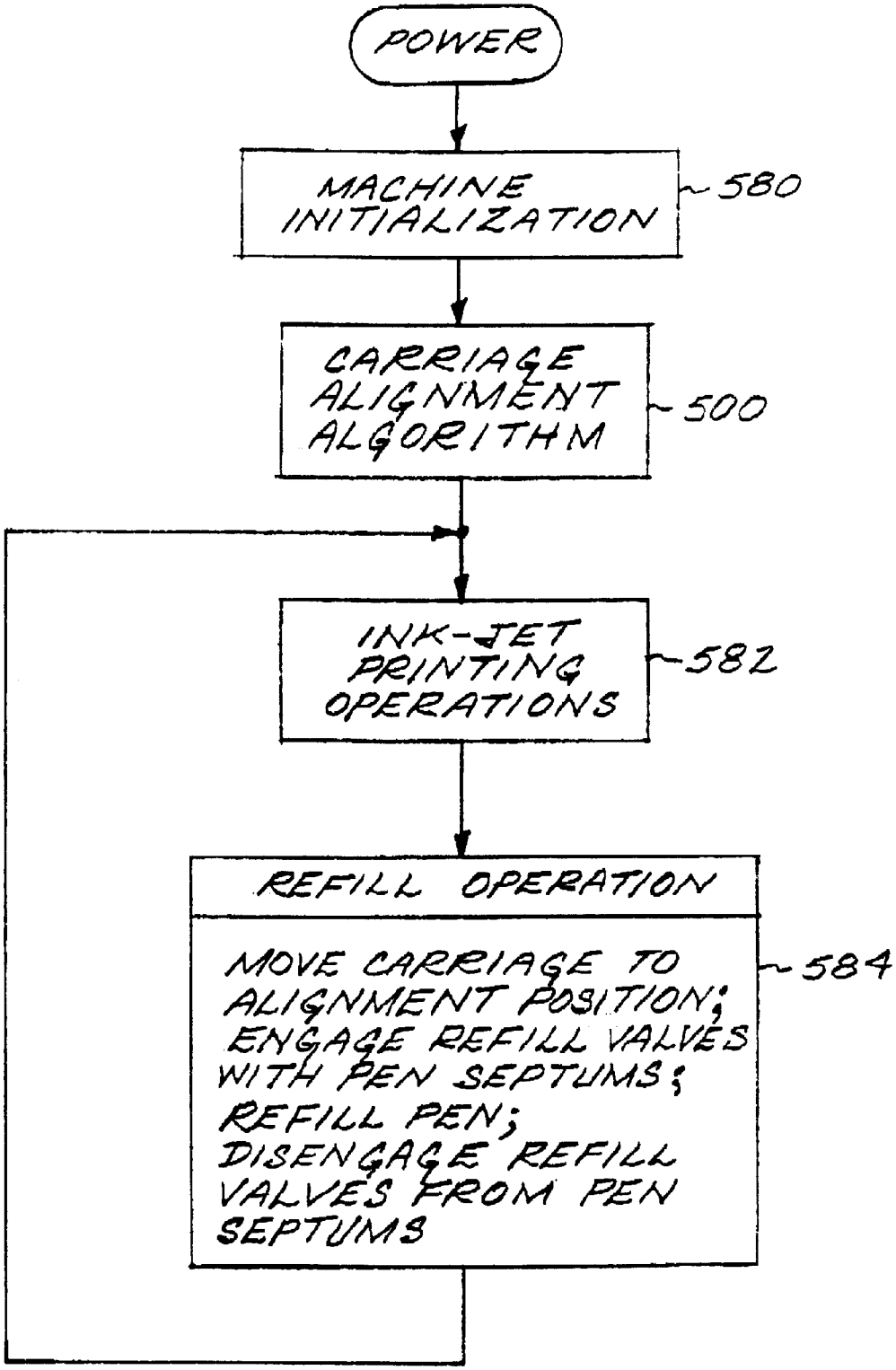
FIG. 22 is a simplified flow diagram generally illustrating the operation of the printing system and its use of the carriage alignment algorithm.

FIG. 22 is a simplified flow diagram generally illustrating the operation of the machine 50 and its use of the carriage alignment algorithm. When power is applied to the machine, an initialization sequence is conducted (580), to initialize various system parameters. Next, the carriage alignment algorithm (500) is performed, to determine the carriage alignment position to be used during refill operations. Under control of the system controller 400, the machine performs ink-jet printing operations at 582, wherein the carriage is driven along the scan axis, and liquid ink droplets are ejected to produce a desired image on a medium surface. The medium is advanced to position the medium for successive carriage printing swaths. Upon completion of the printing operations, or under circumstances determined by the controller 400, a refill operation (584) will be conducted to replenish the ink supply carried on the carriage by the pens 70–76. This refill operation includes the steps of positioning the carriage at the alignment position determined during the algorithm 500, engaging the refill valves with the pen septums, passing ink through the refill valves and the pen septums into the pens, and disengaging the refill valves and the pen septums. Additional printing operations can now be performed.

Carriage Clamping and Pen Septum/Refill Valve Engagement

After the carriage 60 has been aligned at the refill station 600 for a refill operation, the carriage is clamped in position, and the refill valves are moved into engagement with the respective pen septums. The risk of a pen movement relative to the carriage during the clamping engagement process is relatively high, since the force applied to the pens can be relatively high, e.g. about 2 kg per pen, with four pens mounted in the carriage. The consequence of a pen movement is a loss in print quality. It would therefore be advantageous to provide a mechanism of clamping the carriage which would balance the forces such that the net resultant is zero. To achieve this goal, the refill station includes a mechanism that clamps the carriage and allows the clamping and engagement forces to travel from the septum surface up through the clamping features in the carriage, and so avoid any displacement between the carriage and the slider rods, this being the area with a greater risk of movement due to clearances. The refill station in this exemplary embodiment clamps the carriage at four points. Theoretically the carriage should be clamped in only three points instead of four points in order to avoid being redundant in the number of support points, but the shape of the carriage suggests that it is much easier to clamp it in four points due to the carriage's symmetry. In order to avoid any kind of twist in the carriage, due to the four contact points, the clamp is made flexible. The refill mechanism includes two hinges. The first hinge is about a main shaft, with the station frame and the valve holder mounted for independent rotation. The second hinge is between the frame and the clamp. The clamping and actuation mechanism is described with respect to FIGS. 23–32.

Figure 23:
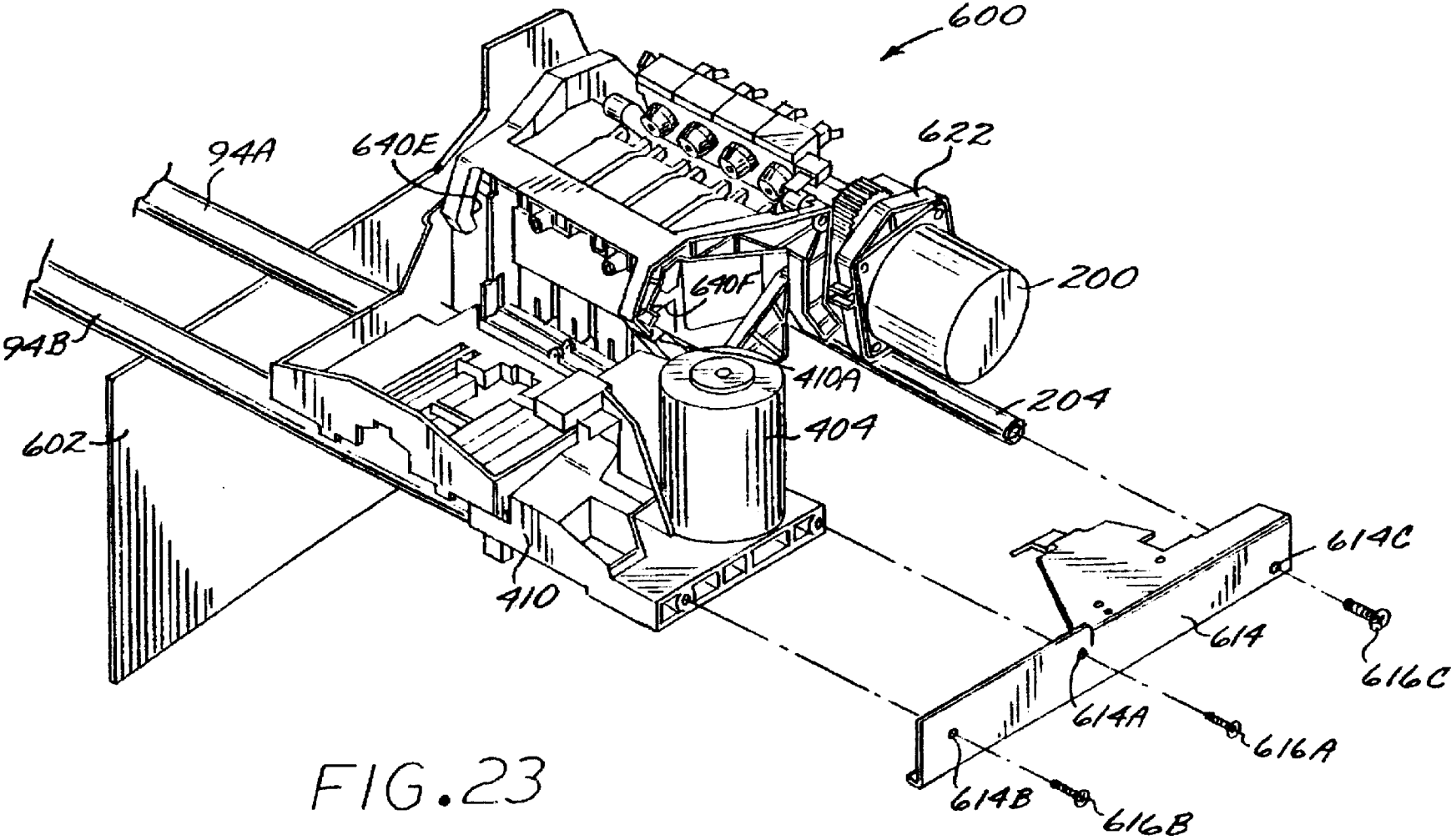
FIG. 23 is an isometric, partially exploded view of the refill station and the left side of the carriage axis assembly.

FIG. 23 is an isometric, partially exploded view of the refill station 600 and the left side of the carriage axis assembly. FIG. 24 is a reverse direction isometric view of the refill station 600 in isolation. The refill station has a fixed support bracket 220 which is secured to the machine chassis. Additional support is provided by a bridge 614 which receives fasteners 616A–616C through holes 614A–614C for insertion in bores formed in the end of the left (motor) holder bracket 410 (which is referenced to the slider rods 94A, 94B) and in the main axle 204. The bridge 614 increases the stiffness of the carriage axis assembly, and provides an accurate link between the slider rods and the refill station (through main axle 204) in order to achieve a better alignment between the refill valves and the pens.

Figure 26:
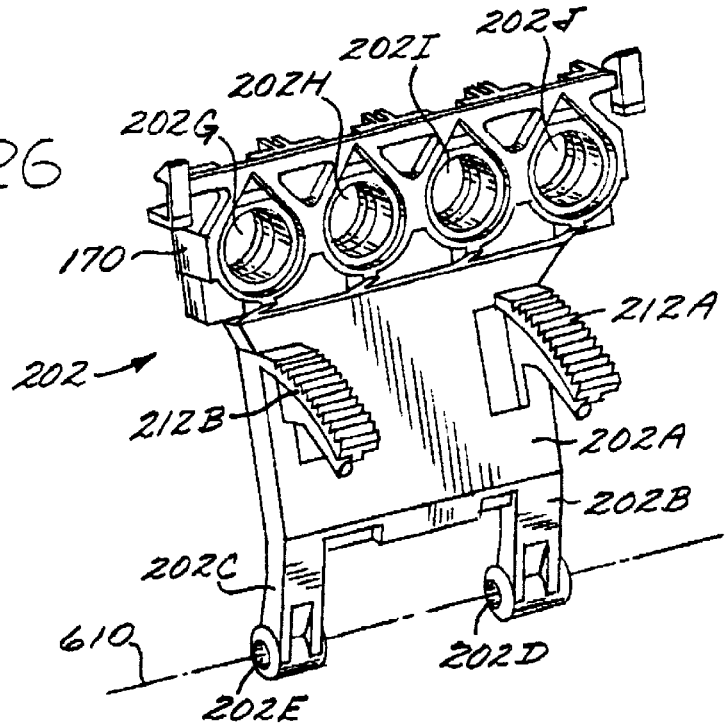
FIG. 26 is an isometric view of the valve support structure of the refill station.

The refill station 600 includes a frame 620, shown in isolation in the isometric view of FIG. 25, and a valve holder 202 shown in isolation in the isometric view of FIG. 26. The frame 620 and the valve holder 202 are each mounted for rotation about the main axle 204. The frame 620 includes a refill mechanism lid 622 to which the motor 200 is mounted. The frame includes a spaced first pair of struts 622A and 622B which have shaft openings 624A, 624B respectively formed therein for receiving therethrough the main shaft 204 along a first hinge axis 610. The frame further includes a spaced second pair of struts 622C, 622D which have respective shaft openings 624C, 624D formed therein for receiving hinge pins 626A, 626B along a second hinge axis 612. The frame is thus mounted for hinging rotation about the main shaft 204, and the motor 200 and its gear train 230 are carried with the frame 620.

Figure 29:
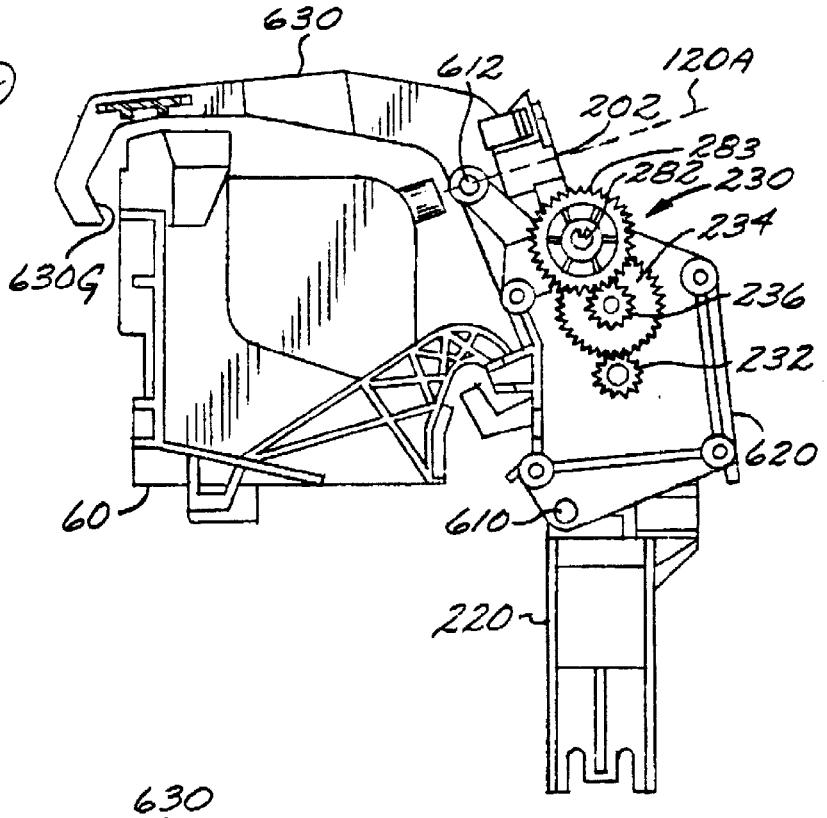
FIG. 29 is a side sectional view taken along line 29—29 of FIG. 24.

The motor gear train is shown in FIGS. 24 and 29, and includes the motor spur gear 232 mounted on the motor shaft, gear 234 which meshes with gear 232, gear 236 which meshes with gear 238, which is mounted on a drive axle 222, and pinion gears 210A, 212B which mesh with the valve holder gear racks 212A, 212B.

FIG. 26 shows the valve holder 202, which includes the gear racks 212A, 212B extending from a main body portion 202A. Extending from one end of the main body portion are a pair of struts 202B, 202C which have respective shaft openings 202D, 202E formed therein for receiving therethrough the main shaft 202 along the first hinge axis 610. The valve holder is sized so that the struts 202B, 202C fit on the shaft 202 between the struts 622A, 622B of the frame 620 when assembled into the refill station. Extending from a second end of the body portion 202A is a valve holder portion 170, which has defined therein a plurality of apertures 202G–202J for receiving the valves 160–166 (FIG. 2) connected to respective supplemental ink supplies. These apertures are aligned in a row which is parallel to the second hinge axis 612.

Figure 27:
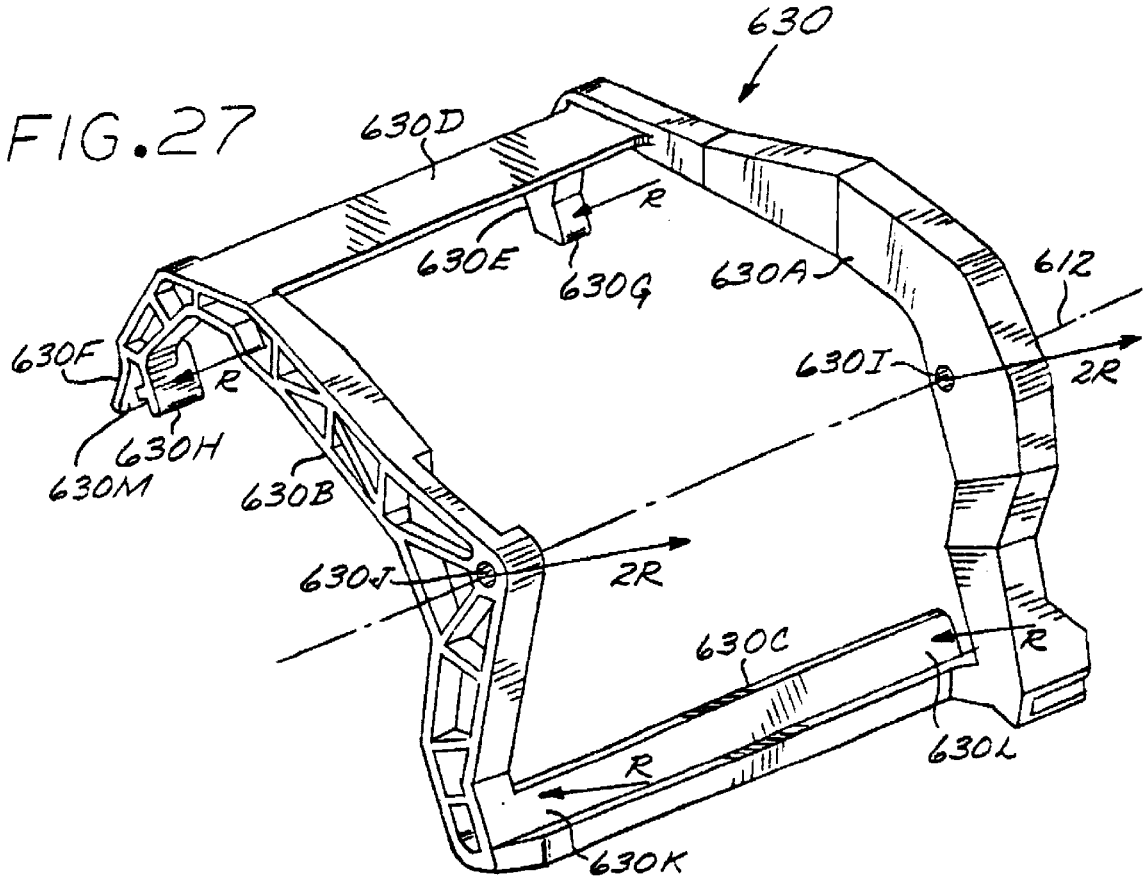
FIG. 27 is an isometric view of the clamp structure of the refill station.

The clamp or cradle 630 is another component of the refill station, and is shown in isolation in the isometric view of FIG. 27. The clamp 630 has two spaced strut portions 630A, 630B, which are joined by two link portions 630D, 630E. The clamp ends of the strut portions terminate in hooks 630E, 630F, which define clamp surfaces 630G, 630H. The link portion 630C defines an elongated flat clamp surface 630I. The strut portions have formed therein openings 630I, 630H formed therein for receiving hinge pins 626A, 626B along the second hinge axis 612. The clamp 630 is sized so that the struts 622C, 622D fit inside the strut portions 630A, 630B along hinge axis 612. The clamp is therefor mounted for rotational movement about the second hinge axis 612, within a range of motion.

It is noted that the valve holder 202 and valve holder portion 170 are arranged to position valves held therein along respective valve axes 120A (FIG. 29) which intersect the second hinge axis 612. The valves held in the holder portion 170 are mounted for rotation about the first hinge axis 610, on a radius equal to the distance between the first and second hinge axes. Further, the valve holder portion 170 supports the valves so that, as the valve holder rotates about the first hinge axis 610 during the engagement process, the valve rotates as well, with its axis extending tangentially to a cylinder centered on the first hinge axis 610, with a radius equal to the distance between the two hinge axes.

The frame 610, valve holder 202 and clamp 630 are each one piece, molded plastic parts in this exemplary embodiment. An exemplary material suitable for the purpose is polyphenil oximetilene, to which glass fibers are added to fabricate the frame and valve holder for added stiffness. No fibers are added to this material in the exemplary embodiment to fabricate the clamp 630, so that the clamp is flexible.

The carriage 60 is provided with two carriage clamp arms 640A, 640B (FIG. 13) which provide clamp surfaces 640C, 640D which engage clamp surface 630I of the refill station 600 during the valve engagement process at the refill station. Two additional carriage clamp surfaces 640E, 640F are provided on the carriage 60 (FIG. 23) which are also engaged at the same time.

Figure 28:
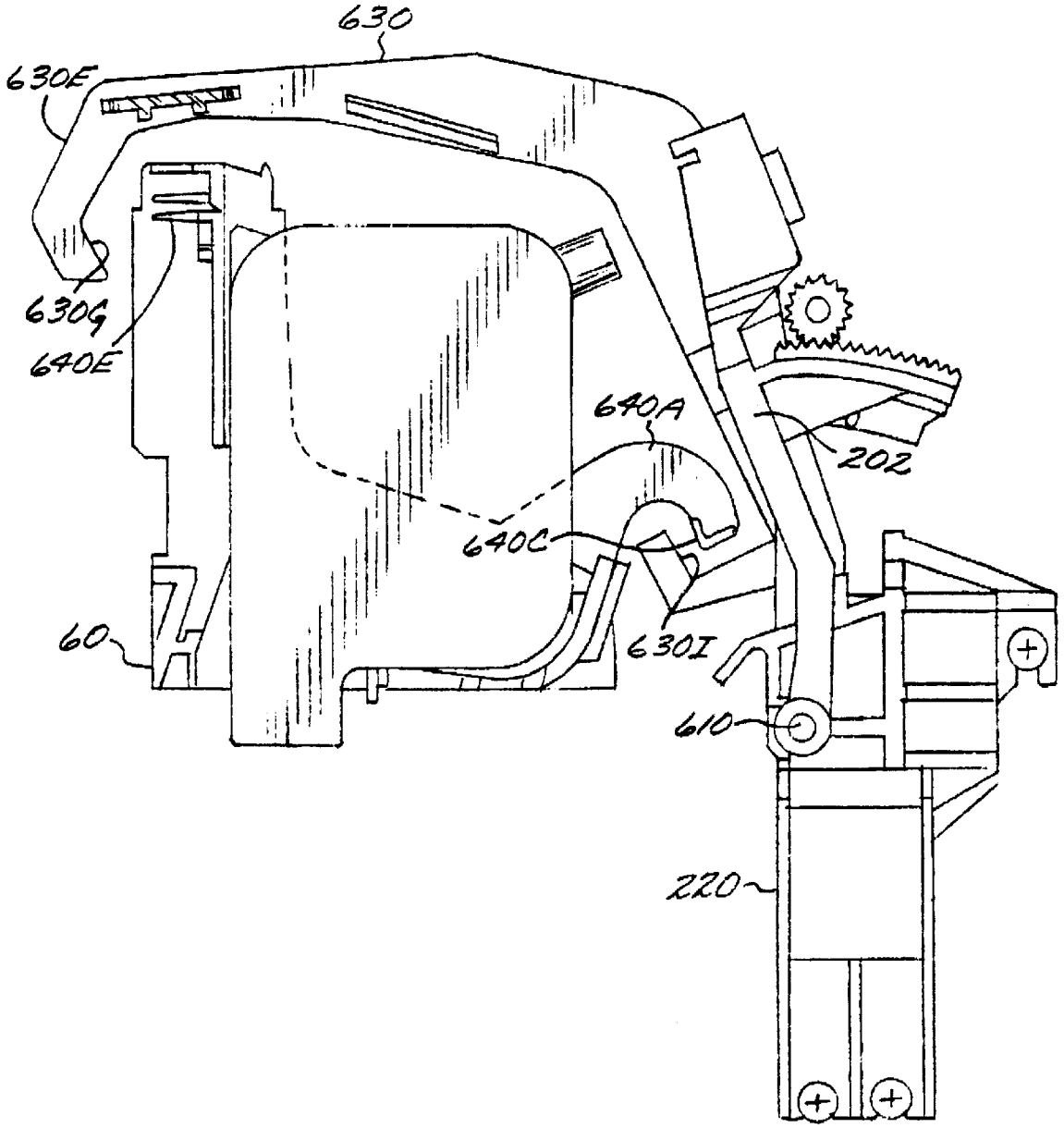
FIG. 28 is a side sectional view taken along line 28—28 of FIG. 24.

The refill station 600 engages the carriage 60 in the following manner, as illustrated in FIGS. 28–32. The carriage is first aligned at the refill station along the carriage axis. FIG. 28 is a simplified side view of elements of the refill station, with the carriage (partially shown in this view) positioned for a refill operation. The frame 620 is not shown in FIG. 28. The valve holder 202 and the clamp 630 are illustrated in their respective positions prior to commencement of the refill operation.

FIG. 29 is a broken-away cross-sectional view showing the frame 620 with the motor gear train 230, the valve holder 202 and the clamp 630 with the carriage in position at the refill station. The carriage is only partially shown in FIG. 29. It will be seen that the refill station components provide clearances permitting the carriage 60 to be passed along the scan axis into the refill station 600.

With the carriage 60 aligned at the refill position, the motor 200 is actuated, turning the pinion gears 212A, 212B through the gear train 230. While the valve holder 202 is free to rotate about the first hinge toward the pen septums in the initial stage of the process, considerable force is required to engage the valves in the pen septums, in this embodiment, about 2 Kg per valve, or 8 Kg for the four valves set in the valve holder. The clamping of the carriage and the valve engagement will be described as separate processes, for purposes of this explanation, although as will be discussed below, the two functions will typically occur simultaneously. Assume that, in this initial stage, then, the valve holder rack remains substantially stationary as the pinion gear rotates, the frame 620 instead rotating due to the torque applied by the motor. As the frame 620 rotates in a clockwise direction about the first hinge axis 610, the clamp 630 is carried by the frame in its movement. As this movement continues, the clearances between the clamp 630 and the carriage 60 are taken up, and the clamp 630 catches or makes contact with the carriage at the four carriage clamp surfaces 640C–640F, as illustrated in FIG. 30. Due to the hinging action of the clamp about the second hinge axis 612, the forces applied by the clamp on the carriage 60 at clamp surfaces 630G–630J are balanced in equilibrium. In the absence of valve engaging forces on the pens held in the carriage, these clamp forces will be quite small, and due to friction in the mechanism.

Figure 31:
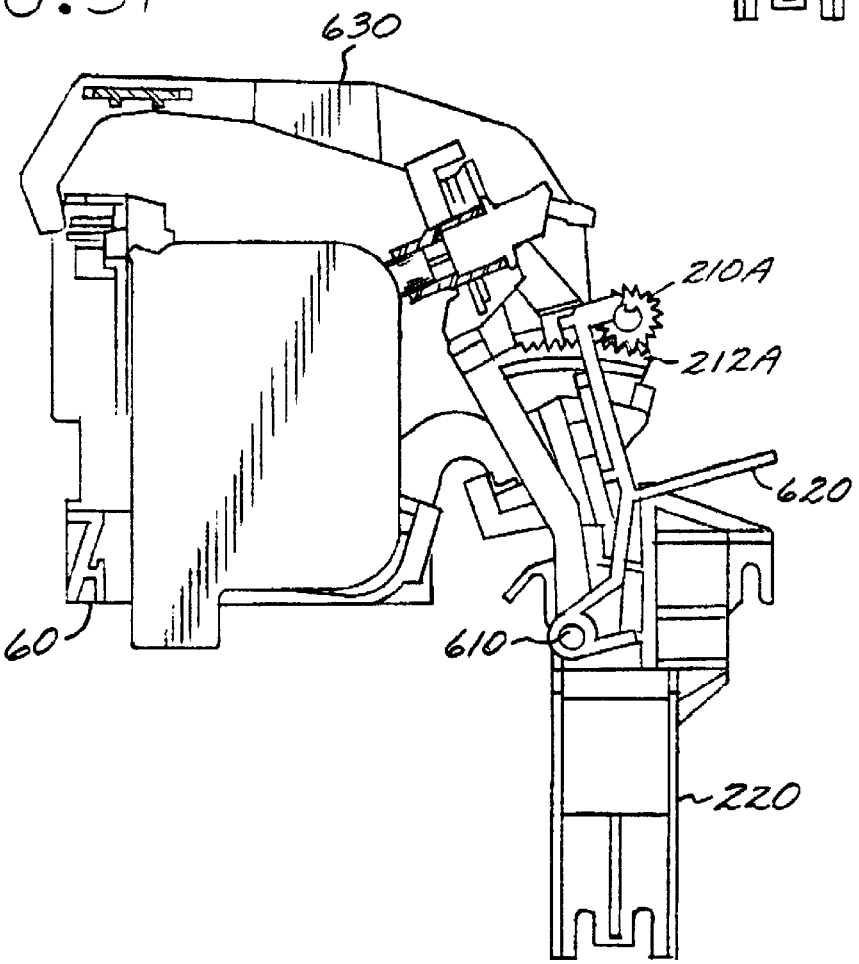
FIG. 31 is a side section view similar to FIG. 30, but showing the valve engaged with the pen.

With the clearances between the clamp surfaces and the carriage taken up, the torque applied by the pinion gear will be transferred to the valve holder gear rack 230, rotating the valve holder counterclockwise about the first hinge axis 610. As this rotation of the valve holder continues, the valves move on an arc of radius equal to the distance between the two hinge axes, into engagement with the pen septums, as illustrated in FIG. 31. A valve arm encoder 402 provides movement/position information to the controller 400 relative to the frame 620, so that the motor 200 is stopped at a predetermined position, with the valves in a fully engaged position relative to the pen septums. The controller 400 counts the number of steps the motor 200 is advanced, from commencement of the movement until the motor is stopped as a result of the sensor signal. Now the refill operation is conducted, with ink from a supplemental off-carriage reservoir being passed through each valve to a corresponding pen septum and into the internal pen reservoir.

Considerable force is exerted by the valves on the pens during the refill operation, e.g. 2 Kg per pen, or a total of 8 Kg with four pens in the cartridge. The clamping mechanism including the clamp 630 and the second hinge about axis 612 exerts clamping forces which balance the large forces exerted on the pen septums by the valves. This is illustrated in FIG. 27, where the force vectors R, indicating the force applied against the clamp surfaces 630G, 630H, 630L, 630K of the clamp 630 by the carriage 60 are exactly counterbalanced by the forces 2R applied to the clamp 60 by the second hinge pins mounted through the openings 630I, 630J.

FIG. 32 illustrates the force equilibrium achieved by the clamp in a conceptual sense. This is a side view of a simple clamp structure 630', mounted for hinging movement about a hinge axis 612'. Also partially shown in broken-away form is a carriage 60' which carries a pen with a refill port septum (not shown) engaged by a valve (not shown) moving along a valve axis 120A, with a force indicated by vector 680 of magnitude F and a direction along the valve axis 120A. The clamp surface 630H' makes contact against carriage surface 640F', and clamp surface 630K' makes contact against clamp surface 640D', exerting forces $R_1$ and $R_2$, respectively. The resultant of the forces applied to the carriage by the clamp and by the valve is effectively zero; the forces are in equilibrium. In a general sense, this is shown by the following. The sum of the moments about either point 1 or point 2 is 0. Assume that point 1 is a distance a from the valve axis 120A, and that point 2 is a distance b from the axis. Thus, $R_2(a+b)=-Fa$, and $R_2=F(a/(a+b))$. Further, $R_1(a+b)=Fa$, and $R_1=F(b/(a+b))$. As a result of this force equilibrium, even though the force F can be relatively large, e.g. 2 Kg per pen, no force is transmitted to the slider rods through the carriage from the engagement force. While only two clamp points are shown in FIG. 32, the clamping/engagement force equilibrium is achieved with three, four (as shown in the exemplary embodiment) or more clamp points.

All these reactions are independent of the overall clamp deformations. This is due to the flexibility of the clamp material and to the flexible shape of the clamp 630. The clamp 630 behaves as an isostatic structure instead of a hyperstatic one. If the clamp surfaces do not lie on the same plane, due to tolerance build-up, the clamp struts and links can flex, taking up the tolerances and achieving contact with the respective four contact surfaces of the carriage. The top hinge about axis 612 makes the reactions independent of the clamp angle or position, allowing wide compliance on the carriage clamping.

As indicated above, once the clearances between the respective clamping points on the clamp 630 and the carriage 60 are taken up during initial activation of the motor drive, further clamping forces by the clamp on the carriage are exerted only in reaction to the valve engagement forces being exerted on the pen septums and thus on the carriage (since the pens are rigidly mounted in stalls of the carriage). Thus, the balancing clamping forces are applied simultaneously with, and in reaction to, the significant valve engagement forces.

Upon completion of the ink refill, the clamping and valve engagement process can be reversed to disengage the valves from the pen septums and release the carriage clamping. The motor is now driven in the reverse direction, i.e. the pinion gears 212A, 212B are driven in the counterclockwise direction. The controller 400 will drive the motor 200 in the reverse direction by a number of motor steps equal to the number counted for the advancing movement, plus a predetermined number of additional steps to ensure that all tolerances have been overcome. The valves are designed in such a way, with a spring, such that a disengagement force is not need to disengage the valves from the pen septums. Due to the spring bias, a holding force is applied by the motor and rack to hold the valves in engagement, and upon release of the holding force, the valves disengage without further externally applied force, since the spring assists in the disengagement. With the motor driven in the reverse direction, the holding force on the valves is released, and the valves will disengage from the pen septums. Torque exerted by the motor will be taken up by the frame, which will now rotate counterclockwise, carrying the clamp with it and releasing the clamping forces applied to the carriage. The clamp defines an end stop surface 630M which contacts a corresponding stop surface 410A on the bracket 410 as the motor continues its reverse drive, stopping travel of the clamp in the counterclockwise direction.

The refill station 600 provides the advantage of single motor actuation of two functions, the clamping of the carriage to the refill station, and the engagement of the valves with the pen septums to permit replenishment of the pen reservoir. The ability to use a single motor for multiple purposes results in reduced cost, complexity, weight, and size, increased reliability and simplified control electronics.

While the clamping mechanism of the disclosed system operates to engage the carriage to stabilize the carriage during pen engagement and refilling procedures, the pens could be individually engaged by individual clamps which operate independently to apply clamping forces to pen surfaces which compensate the pen engagement forces.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. In a printing machine including a carriage axis assembly including a carriage holding a pen and a motor drive system for moving the carriage along a carriage axis between first and second ends of carriage travel along the carriage axis, the pen including a nozzle array, a supply of ink and a refill port separate from the nozzle array, a carriage position sensor, and a refill station disposed along the axis and having a refill stopper surface and a refill valve, a method of replenishing the pen ink supply comprising:

calibrating the position of the refill port on the pen in relation to the refill station by:

actuating the motor drive system to move the carriage in a first direction along the carriage axis to said first end of carriage travel;

sensing the position of the carriage at the first end of carriage travel with the carriage position sensor, and storing the sensed first end position;

actuating the motor drive system to move the carriage in a second direction along the carriage axis until the carriage runs into contact with the refill stopper surface of the refill station; and determining and storing a refill stopper carriage position at which the carriage runs into the refill stopper surface;

moving the carriage along the carriage axis during printing operations and dispensing liquid ink from the nozzle array; and conducting a refill operation by moving the carriage to the refill stopper position, engaging the valve with the refill port on the pen, and passing ink through the valve and the refill port into the pen.

2. The method of claim 1 wherein the carriage axis assembly includes a first side stopper surface, and the printing machine includes a first holder structure disposed at said first carriage axis end having a first end stopper surface, and wherein said step of sensing the position of the carriage at the first end of carriage travel comprises the steps of:

moving the carriage in the first direction with the motor drive system until the carriage first side stopper surface runs into and makes contact with the first end stopper surface;

increasing a motor torque applied by the motor drive system until a high drive limit is reached and the carriage has stopped moving, and setting the motor drive system to a stopped state;

sensing a first resulting stopped position of the carriage and storing said first resulting stopped position as a first stored position;

moving the carriage in the second direction for a distance, and driving the motor to move the carriage again in the first direction until the carriage first side stopper surface runs into and makes contact with the first end stopper surface, and setting the motor drive system to a stopped state after the motor drive system has reached a fine drive limit which is lower than the high drive limit;

sensing a second resulting stopped position of the carriage as the first end reference position.

3. The method of claim 2 further including the step of comparing a magnitude of a difference between the first end reference position and the first stored position to an error threshold value and determining that a system error has occurred if the difference exceeds the error threshold value.

4. The method of claim 1 wherein the carriage includes a second side stopper surface, and wherein said step of determining a refill stopper carriage position at which the carriage runs into the refill stopper surface comprises the steps of:

increasing a motor torque applied by the motor drive system until a high drive limit is reached and the carriage has stopped moving in the second axis direction, and setting the motor drive system to a stopped state;

sensing a first resulting stopped position of the carriage and storing said first resulting stopped position as a second stored position;

moving the carriage in the first direction for a distance, and driving the motor to move the carriage again in the second direction until the second side carriage stopper surface runs into and makes contact with the refill stopper surface, and setting the motor drive system to the stopped state after the motor drive system has reached a fine drive limit which is lower than the high drive limit; and sensing the position of the carriage at its stopped state as said refill stopper carriage position.

5. The method of claim 4 further including the step of comparing a magnitude of a difference between the refill stopper carriage position and the first stored position to an error threshold value and determining that a system error has occurred when the magnitude of the difference exceeds the error threshold value.

6. The method of claim 1 further including the step of subtracting a refill station constant value from said refill station carriage position to determine a refill station alignment position.

7. The method of claim 6 wherein the refill station constant value is determined by a distance between said refill station stopper surface and a refill valve comprising the refill station.

8. The method of claim 1 wherein the pen includes a pen septum, and the refill station includes a refill valve which is engageable with the pen septum during a refill operation, and wherein said refill stopper carriage position is related to a carriage alignment position wherein said pen septum is aligned with said refill valve.

9. The method of claim 1 wherein said calibrating step is performed automatically without interaction from the user.

10. The method of claim 1 wherein said calibrating step is performed automatically upon powerup of the printing machine without any interaction from the user.

11. In a printing machine including a carriage axis assembly including a carriage holding an ink-jet pen having a printhead nozzle array and a pen septum separate from the nozzle array, and a motor drive system for moving the carriage along a carriage axis, a carriage position sensor, and a refill station disposed along the axis and including a refill valve which is engageable with the pen septum during a refill operation, a method of ink-jet printing including the following steps:

determining a carriage alignment position of the carriage at which the pen septum is aligned with the refill valve during an alignment process, said alignment process position determining including (i) actuating the motor drive system to move the carriage in a first direction along the carriage axis to a first end of carriage travel along the carriage axis, (ii) sensing the position of the carriage at the first end of carriage travel, and storing the sensed first end position, (iii) actuating the motor drive system to move the carriage in a second direction along the carriage axis until the carriage runs into contact with a refill stopper surface of the refill station, (iv) determining a refill stopper carriage position at which the carriage runs into the refill stopper surface, and (v) determining the alignment position from the refill stopper carriage position;

moving the carriage along the carriage axis during printing operations and dispensing droplets of liquid ink from the printhead onto a print medium; and conducting a refill operation by moving the carriage to the alignment position, engaging the pen septum and the refill valve to provide a fluid path through the refill valve and the pen septum, passing replenishment ink through the refill valve and the pen septum to refill the pen, and disengaging the refill valve from the pen septum.

12. The method of claim 11 wherein the carriage axis assembly includes a first side stopper surface, and the printing machine includes a first holder structure disposed at said first carriage axis end having a first end stopper surface, and wherein said step of sensing the position of the carriage at the first end of carriage travel comprises the steps of:

driving the motor to move the carriage in the first direction until the carriage first side stopper surface runs into and makes contact with the first end stopper surface;

increasing a motor torque applied by the motor drive system until a high drive limit is reached and the carriage has stopped moving, and setting the motor drive system to a stopped state;

sensing a first resulting stopped position of the carriage and storing said first resulting stopped position as a first stored position;

moving the carriage in the second direction for a distance, and driving the motor to move the carriage again in the first direction until the carriage first side stopper surface runs into and makes contact with the first end stopper surface, and setting the motor drive system to a stopped state after the motor drive system has reached a fine drive limit which is lower than the high drive limit;

sensing a resulting second stopped position of the carriage as the first end reference position.

13. The method of claim 12 further including the step of comparing a magnitude of a difference between the first end reference position and the first stored position to an error threshold value and determining that a system error has occurred if the difference exceeds the error threshold value.

14. The method of claim 11 wherein the carriage includes a second side stopper surface, and wherein said step of determining a refill stopper carriage position at which the carriage runs into the refill stopper surface comprises the steps of:

increasing a motor torque applied by the motor drive system until a high drive limit is reached and the carriage has stopped moving in the second axis direction, and setting the motor drive system to a stopped state;

sensing a first resulting stopped position of the carriage and storing said first resulting stopped position as a second stored position;

moving the carriage in the first direction for a distance, and driving the motor to move the carriage again in the second direction until the second side carriage stopper surface runs into and makes contact with the refill stopper surface, and setting the motor drive system to the stopped state after the motor drive system has reached a fine drive limit which is lower than the high drive limit; and sensing a resulting second stopped position of the carriage as said refill stopper carriage position.

15. The method of claim 14 further including the step of comparing a magnitude of a difference between its stopped state and the first stored position to an error threshold value and determining that a system error has occurred when the magnitude of the difference exceeds the error threshold value.

16. The method of claim 11 further comprising the steps of:

providing an off-carriage ink supply containing a quantity of the replenishment ink; and connecting the off-carriage ink supply through a fluid path to the refill valve.

17. The method of claim 11 wherein said carriage alignment determining step is performed automatically without interaction from the user.

18. The method of claim 11 wherein said carriage alignment determining step is performed automatically upon powerup of the printing machine without any interaction from the user.

19. In a color printing machine including a carriage axis assembly including a carriage holding a plurality of ink-jet pens, each ink-jet pen having a printhead, a reservoir for holding a supply of ink, and a pen septum communicating with the reservoir, and a motor drive system for moving the carriage along a carriage axis, a carriage position sensor, and a refill station disposed along the axis and including a plurality of refill valves, each valve engageable with a corresponding pen septum during a refill operation, a method of ink-jet printing including the following steps:

determining a carriage alignment position of the carriage at which the pen septums are aligned with the corresponding refill valves during an alignment process, said alignment positioning determining including (i) actuating the motor drive system to move the carriage in a first direction along the carriage axis to a first end of carriage travel along the carriage axis, (ii) sensing the position of the carriage at the first end of carriage travel, and storing the sensed first end position, (iii) actuating the motor drive system to move the carriage in a second direction along the carriage axis until the carriage runs into contact with a refill stopper surface of the refill station, (iv) determining a refill stopper carriage position at which the carriage runs into the refill stopper surface, and (v) determining the alignment position from the refill stopper carriage position;

moving the carriage along the carriage axis during printing operations and dispensing droplets of liquid ink from the printheads onto a print medium; and conducting a refill operation by moving the carriage to the alignment position, engaging the respective pen septums and the refill valves to provide respective fluid paths through the refill valves and the pen septums, passing replenishment ink through the refill valves and the pen septums to refill the pens, and disengaging the refill valves from the pen septums.

20. The method of claim 19 wherein the respective pens are for printing with inks of different colors.

21. The method of claim 20 further comprising:

providing each said pen with an initial supply of ink.

22. The method of claim 20 further comprising:

providing a plurality of off-carriage ink supplies each containing a quantity of liquid ink of the ink of the respective different colors, each of said plurality of ink supplies connected to a corresponding refill valve through a fluid path.

* * * * *